US005224509A

United States Patent [19]

Tanaka et al.

[11] Patent Number: 5,224,509

[45] Date of Patent: Jul. 6, 1993

[54] AUTOMATIC FAUCET

[75] Inventors: Hiroshi Tanaka; Koji Morita; Koji Nakano; Yukihiro Muroya, all of Fukuoka, Japan

[73] Assignee: Toto Ltd., Fukuoka, Japan

[21] Appl. No.: 576,488

[22] PCT Filed: Jan. 12, 1990

[86] PCT No.: PCT/JP90/00032

§ 371 Date: Oct. 29, 1990

§ 102(e) Date: Oct. 29, 1990

[87] PCT Pub. No.: WO90/08236

PCT Pub. Date: Jul. 26, 1990

[30] Foreign Application Priority Data

Jan. 13, 1989 [JP] Japan ..... 1-3181

[51] Int. Cl.[5] ..... F16K 11/24

[52] U.S. Cl. ..... 137/315; 137/607; 137/801; 251/129.04

[58] Field of Search ..... 137/607, 801, 315; 251/129.04

[56] References Cited

U.S. PATENT DOCUMENTS 4,681,141 7/1987 Wang ..... 137/607
4,762,273 8/1988 Gregory et al. ..... 251/129.04 X
4,886,207 12/1989 Lee et al. ..... 251/129.04 X
4,894,874 1/1990 Wilson ..... 251/129.04 X

FOREIGN PATENT DOCUMENTS 3537678 4/1987 Fed. Rep. of Germany ..... 251/129.04
1-79481 3/1989 Japan ..... 137/801

*Primary Examiner*—Stephen M. Hepperle
*Attorney, Agent, or Firm*—Jordan and Hamburg

[57] ABSTRACT

An automatic faucet according to the present invention is characterized in that a protective cover for a sensor or the like is removably mounted in a superposed state on the inner surface of a spout body integrally formed with a discharge water flow path within the wall to constitute a spout, and a sensor or the like fitting space for storing a manual sensor, a sensor cord and the like is formed between the spout body and the protective cover for the sensor or the like. That is, the spout constituting the principal portion of the automatic faucet is substantially formed by assembling the mutually independent spout body having formed therein the discharge water flow path and protective cover for the sensor or the like. Accordingly, the spout of the automatic faucet can be assembled easily. When any trouble occurs with the manual sensor or the like or the sensor cord is broken, the protective cover for the sensor or the like can be removed rapidly from the spout body and the broken portion can be fixed or replaced easily.

17 Claims, 19 Drawing Sheets

AUTOMATIC FAUCET

The present invention relates to an automatic faucet capable of turning on and off the water on the basis of a sensor output from a manual sensor or the like.

BACKGROUND OF THE INVENTION

According to one form of an automatic faucet, in the past, a spout is formed of casting, the interior of which is divided by a partitioning wall into two spaces to constitute a two-layer construction, one space being used as a discharge water flow path, the other space being used as a space in which a manual sensor such as an infrared sensor or a control unit is mounted, and a sensor cord or the like is provided.

In such a spout as described above, behavior of a user's hand is detected by a manual sensor, while maintaining a compact shape thereof, and an electromagnetic closing valve or the like is driven on the basis of the detected output so that operation of turning on and off the water can be performed automatically. Since it is not necessary to operate the closing valve directly by the hand, the using mode can be materially improved.

However, the spout cannot be disassembled because it is an integrally molded article formed by casting or the like. Therefore, the work for mounting a manual sensor or a control unit into the spout and the work for wiring a sensor cord to the sensor are cumbersome.

As a result, the manufacturing cost for the automatic faucet is high, and when any trouble occurs, maintenance therefor cannot be carried out easily.

It is an object of the present invention to provided an automatic faucet which can solve the aforementioned task.

DISCLOSURE OF THE INVENTION

The present invention provides an automatic faucet wherein a protective cover for a sensor or the like is fitted in a superposed state and removably to the inner suface of spout body with a discharge water flow path formed integrally inside a wall so as to constitute a spout, and a space for accommodating the sensor or the like is formed between the spout body and the protective cover for the sensor or the like.

In this invention, the spout constituting the principal portion of the automatic faucet is formed by assembling substantially the mutually independent spout body having formed therein the discharge water flow path and the protective cover for the sensor or the like.

Accordingly, the manual sensor or the like can be fitted in advance on the protective cover for the sensor or the like, and the sensor cord can be wired in advance along the inner surface of the protective cover for the sensor or the like. Thereafter, the protective cover for the sensor or the like is mounted on the inside of the spout body whereby the spout of the automatic faucet can be easily assembled.

Further, when any trouble occurs with the manual sensor or the like or the sensor cord is broken, the protective cover for the sensor or the like can be removed rapidly from the spout body and the broken portion can be fixed or replaced easily.

BEST MODE FOR CARRYING OUT THE INVENTION

The present invention will be described with reference to the accompanying drawings for describing the present invention in detail.

Figure 1:
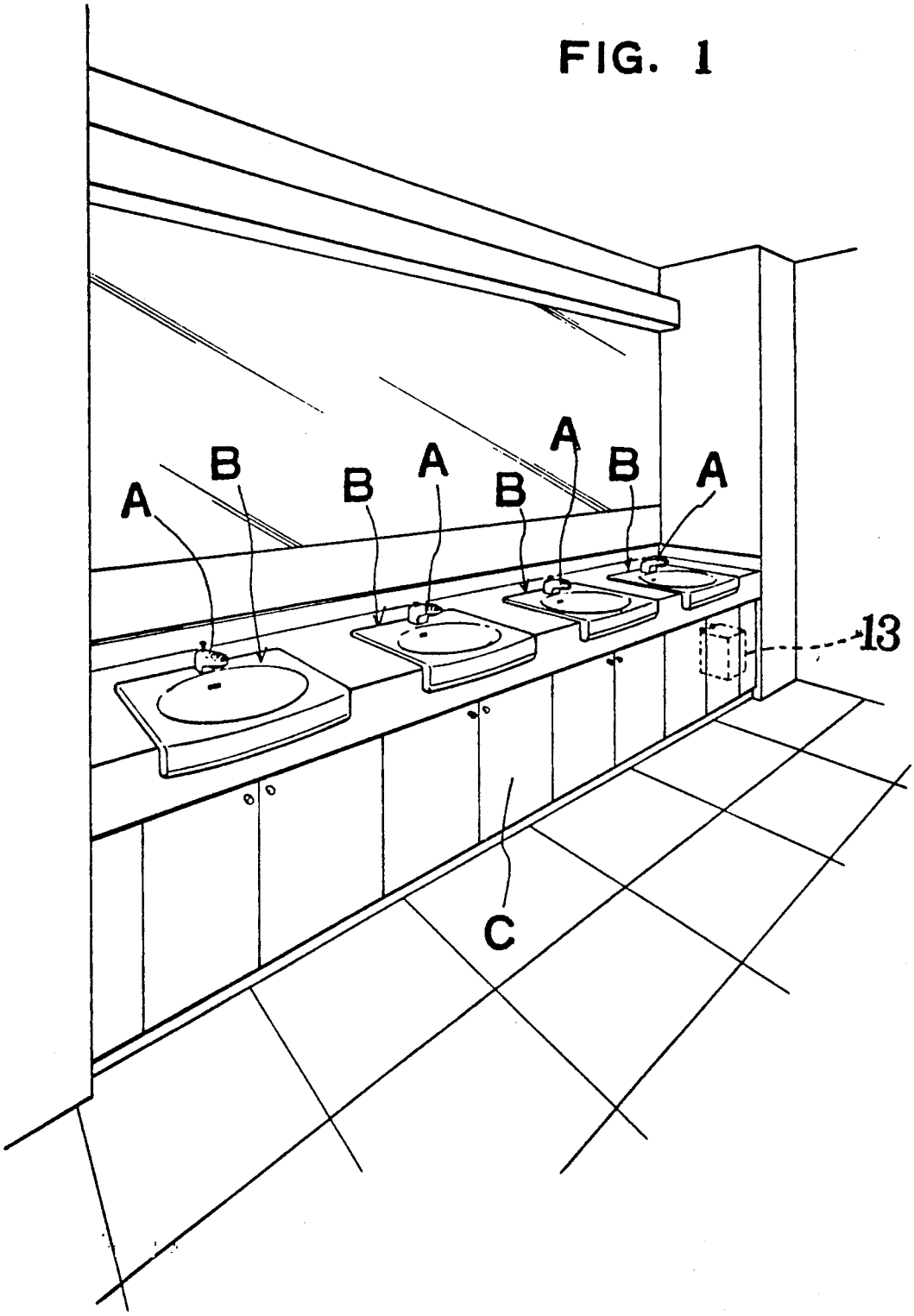
FIG. 1 is a perspective view of the interior of a toilet room having many washbowls each equipped with an automatic faucet according to the present invention.

FIG. 1 shows the interior of a toilet room in which many washbowls B are mounted on a cabinet C, each washbowl B being equipped with an automatic faucet A according to the present invention, as shown in the drawings.

Figure 2:
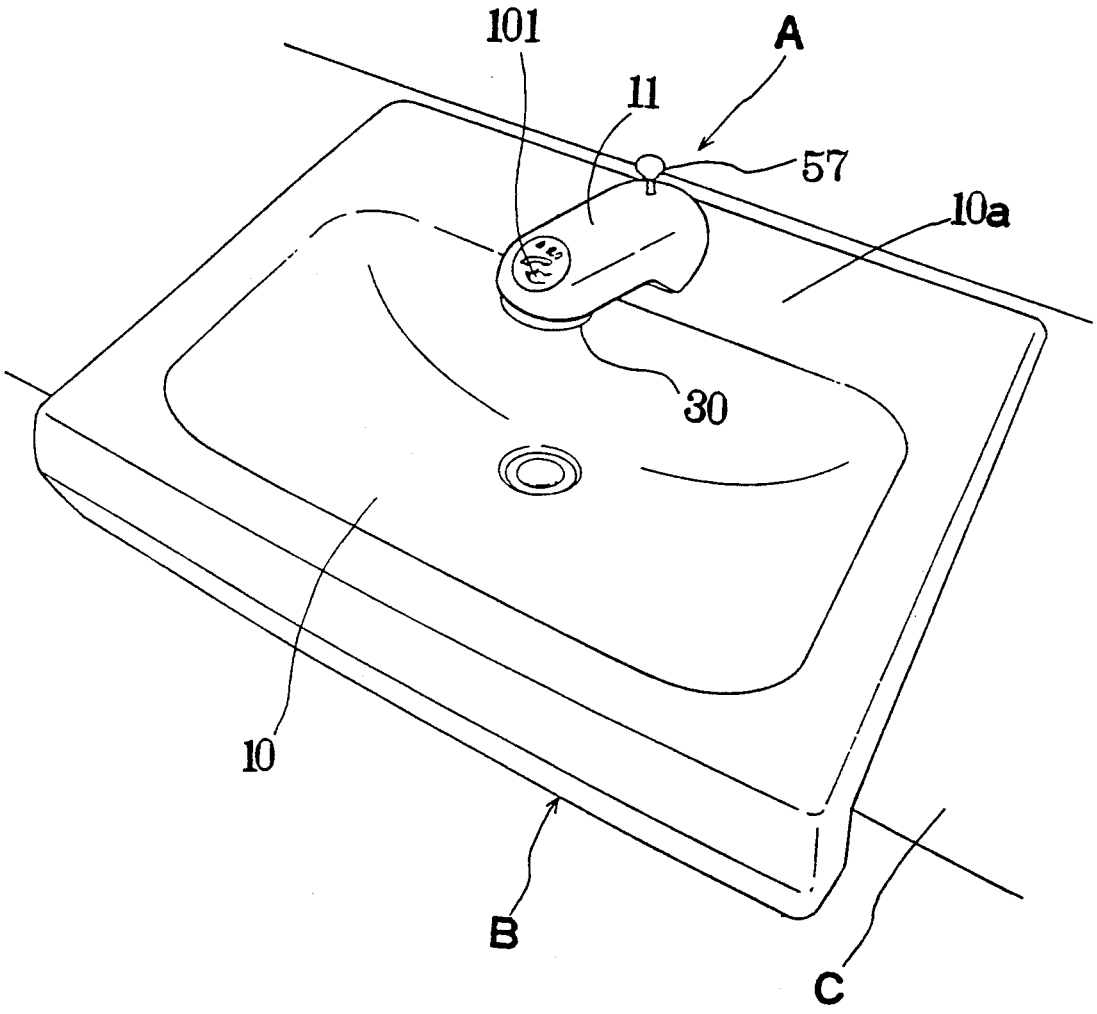
FIG. 2 is a perspective view of the washbowl.
Figure 3:
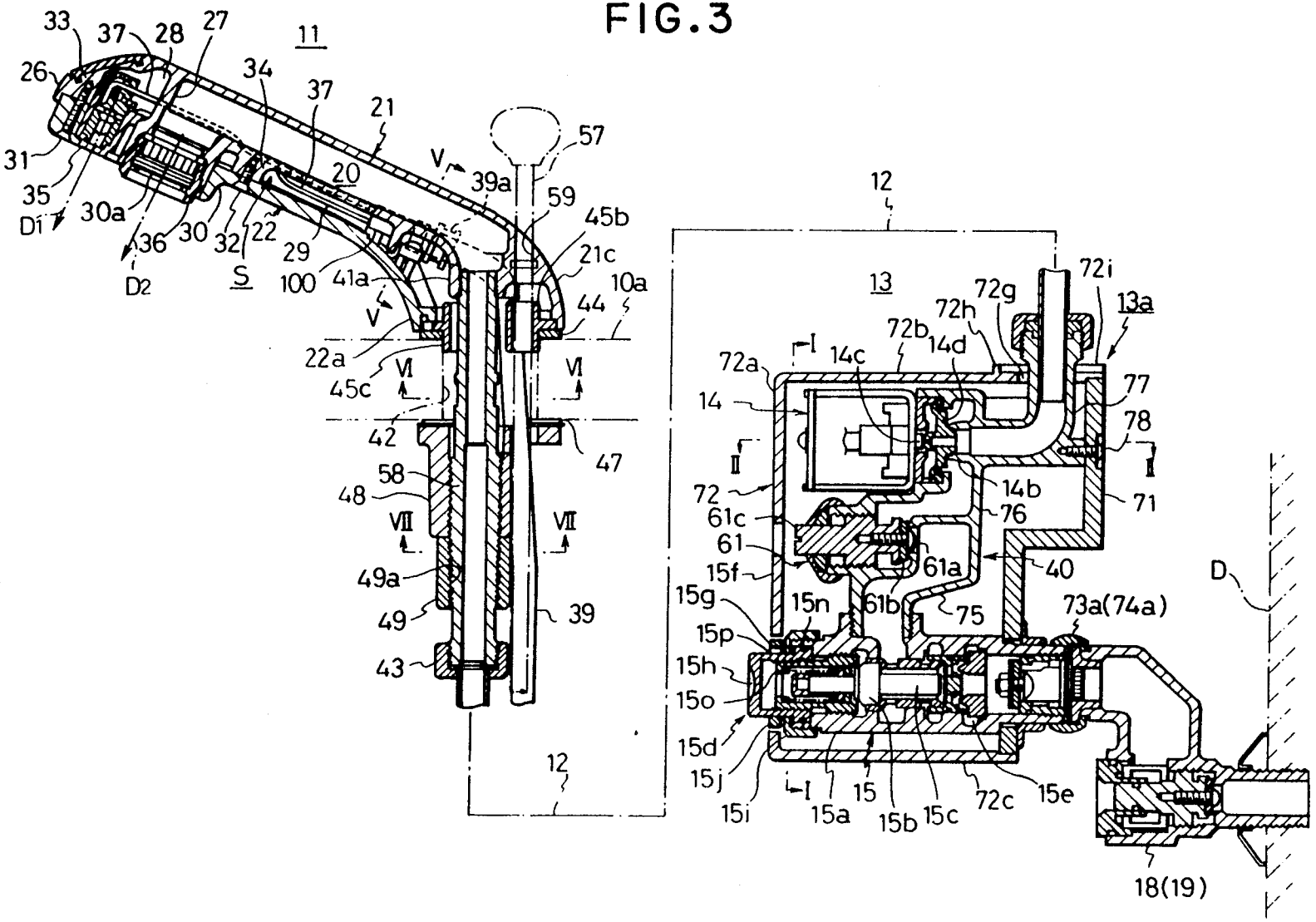
FIG. 3 is a sectional side view showing the entire consrtruction of the automatic faucet.

FIGS. 2 and 3 show the entire construction of the washbowl B and the automatic faucet A. As shown in the drawings, the washbowl B is fitted in and secured to a fitting groove cut in a counter forming an upper portion of the cabinet C.

Next, the entire construction of the automatic faucet A will be described with reference to FIG. 3. A spout 11 is fixedly mounted on a mounting surface 10*a* in the inner part of a bowl 10 of the washbowl B, and a drive portion unit 13 connected in communication to the spout 11 through a hot water supply pipe 12 is disposed at the lower part of the bowl 10.

In the above-described construction, as shown in FIG. 3, the drive portion unit 13 integrally encases therein an electromagnetic closing valve 14 connected in communication to an upstream side of the hot water supply pipe 12, a thermostat type mixing valve 15 connected in communication to the electromagnetic closing valve 14, a control device 16 for controlling the operation of the electromagnetic closing valve 14 and various sensors described later, and a power supply device 17.

Figure 4:
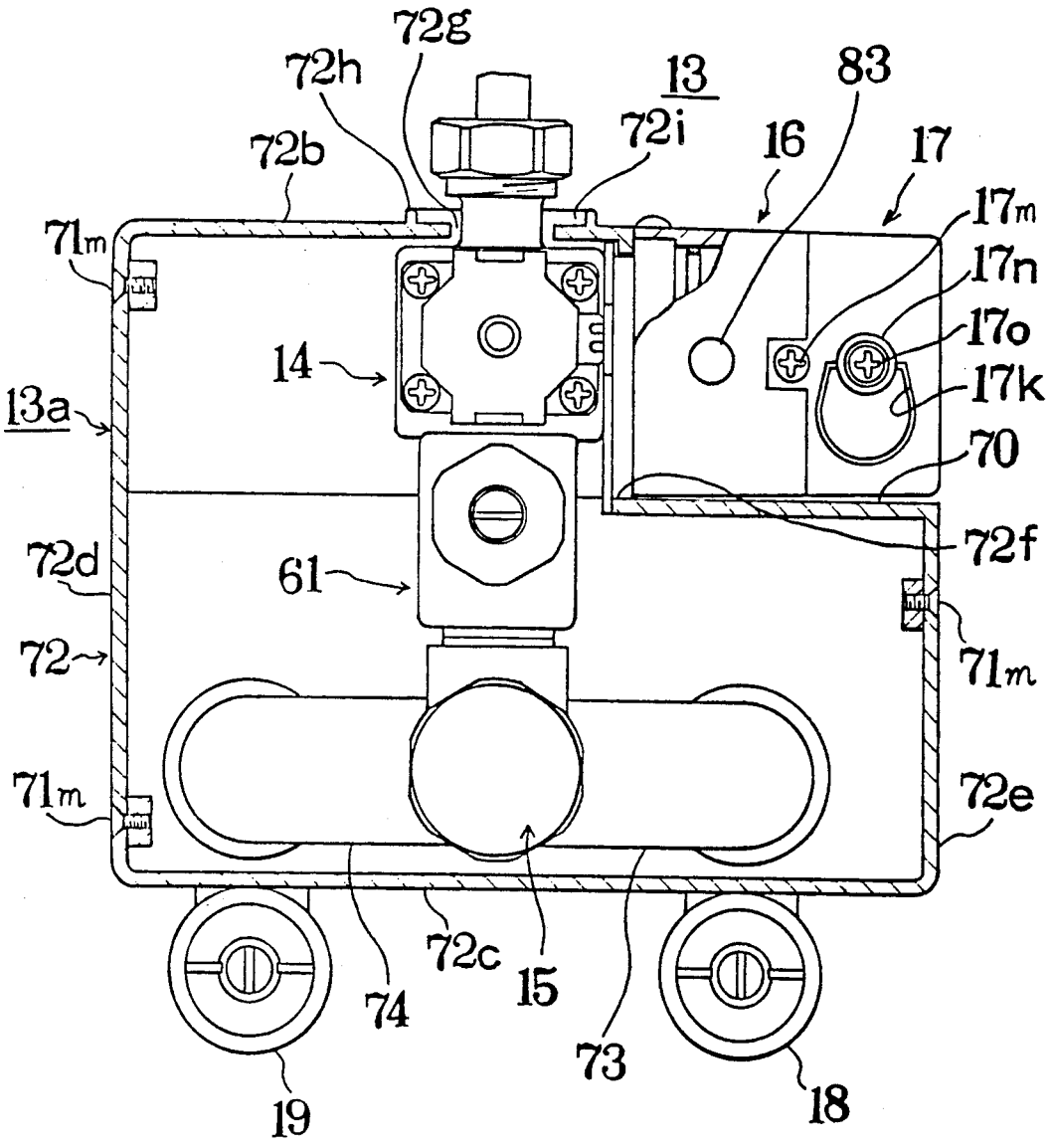
FIG. 4 is a sectional side view of a valve control box taken on line I—I of FIG. 3.
Figure 5:
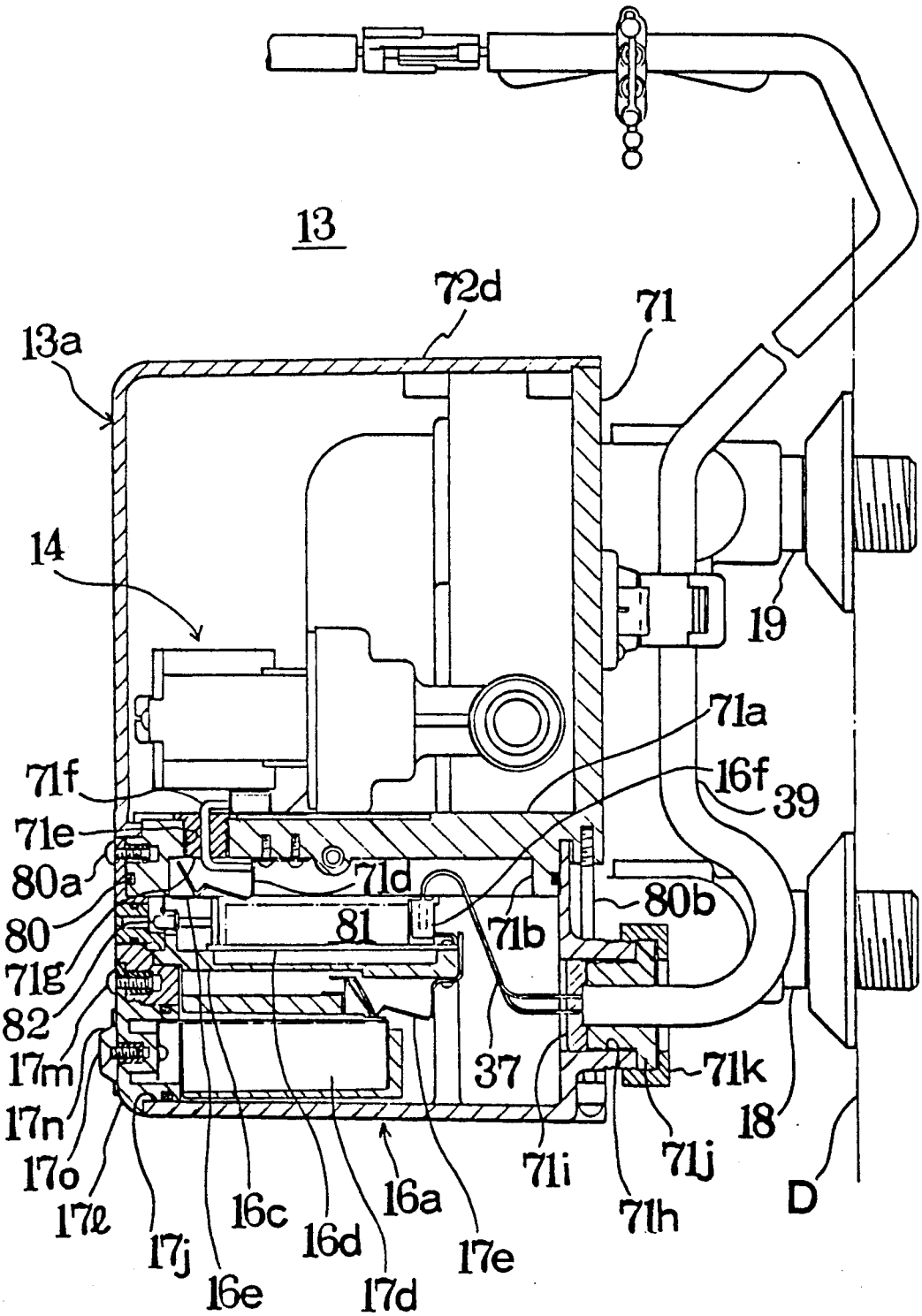
FIG. 5 is a sectional plan view of the valve control box taken on line II—II of FIG. 3.

As shown in FIGS. 4 and 5, openings on the other side of a pipe 18 on the hot water side and a pipe 19 on the cold water side of which one end is embedded in and supported on the wall D are connected in communication with a hot water opening and a cold water opening of the thermostat type mixing valve 15.

Water stop valves are housed in the base portions of the pipe 18 on the hot water side and the pipe 19 on the water side, respectively.

In the construction as described above, when the electromagnetic closing valve 14 is driven and opened, mixed hot water having a suitable temperature can be discharged from the spout 11 into the washbowl B through the pipe 18 on the hot water side, the pipe 19 on the water side, the thermostat type mixing valve 15, the electromagnetic closing valve 14, the hot water supply pipe 12.

Parts constituting the aforesaid automatic faucet A will be described in detail hereinafter.

First, the construction of the drive portion unit 13 constituting the subject matter of the present invention will be described in detail with reference to FIGS. 3 to 9.

Referring to FIGS. 3 to 5, particularly to FIG. 4, the drive portion unit 13 is constituted by removably connecting a control device 16 in the shape of a small rectangular box and a power supply device 17 in a rectangular space 70 formed at one side corner at the upper portion of a body case 13*a* in the shape of a rectangular box.

In the above-described construction, the body case 13*a* consists of a base plate 71 on the wall side which is thick and substantially in the shape of a rectangular plate and a thin box-like cover 72 removably connected to the base plate 71 on the wall side by means of a connecting bolt 71*m*.

The box-like cover 72 is formed from a front plate 72*a*, a top plate 72*b*, a bottom plate 72*c* and left and right side plates 72*d* and 72*e*.

The box-like cover 72 is provided with an opening 72*f* for connecting the control device at a location at the upper portion of the right side plate 72*e* and connected to the control device 16.

The internal construction of the body case 13*a* will now be described. In the central portion within the body case 13*a*, there are disposed a thermostat type mixing valve 15, a water stop valve 61 and an electromagnetic closing valve 14 in that order vertically from bottom to top on a hot water supply flow path 40.

In the thermostat type mixing valve 15, a cylindrical body 15*a* encases a movable (forward and backward) valve stem 15*b* for adjusting a valve opening degree according to a temperature of mixed hot water whereby the temperature of the mixed hot water can be automatically adjusted to a set temperature.

The cylindrical body 15*a* of the thermostat type mixing valve 15 is connected to a pair of bent pipes 73 and 74 which, at one portion, extend laterally as shown in FIG. 4 and thereafter extend through a base plate 71 on the wall side of the body case 13*a* and project outside as shown in FIG. 3. The bent pipes 73 and 74 are removably connected to the pipe 18 on the hot water side and the pipe 19 on the water side by annular connecting fittings 73*a* and 74*a*, respectively, as shown in FIG. 3.

The water stop valve 61 consists of a valve plate 61*b* for turning off an opening 61*a* provided in the midst of the hot water supply flow path 40 and a threaded rod 61*c* for moving the valve plate 61*b* forward and backward, which is used to fix trouble which may occur on the downstream side from the electromagnetic closing valve 14.

The electromagnetic closing valve 14 used in the present embodiment comprises a diaphragm valve which is operated by a latching solenoid. Upon application or release of voltage, the electromagnetic closing valve 14 can cause a plunger 14*c* thereof to be moved forward and backward, a valve body 14*a* formed from a diaphragm to come into contact with or to move away from a valve seat 14*b* and an opening 14*d* remotely provided at the upper portion of the hot water supply flow path 40 to be opened and closed.

The hot water supply flow path 40 provided interiorly of the drive portion unit 13 will be described hereinafter. The flow path 40 comprises a first hot water supply internal pipe 75 connected in communication with the thermostat type mixing valve 15 and the water stop valve 61, a second hot water supply internal pipe 76 connected in communication to the water stop valve 61 and the electromagnetic closing valve 14, and a third hot water supply internal pipe 77 connected in communication to the electromagnetic closing valve 14 and the hot water supply pipe 12.

In the above-mentioned construction of the hot water supply flow path 40, as shown in FIG. 3, an upper portion of the base plate 71 on the wall side of the body case 13*a* is connected and secured to the third hot water supply internal pipe 77 by means of a fastening screw 78, and a lower portion of the base plate 71 on the wall side is supported by the bended pipes 73 and 74.

Accordingly, in the present embodiment, the drive portion unit 13 is substantially supported in a cantilever fashion by the pipe 18 on the hot water side and the pipe 19 on the water side embedded in and supported on the wall D through the base plate 71 on the wall side of the body case 13*a*, the hot water supply flow path 40 and the bent pipes 73 and 74.

The drive portion unit 13 can be easily removed from and connected to the pipe 18 on the hot water side and the pipe 19 on the water side by loosening and tightening annular connecting fittings 73*a* and 74*a* shown in FIG. 3.

The body case 13*a* can separate the base plate 71 on the wall side and the box-like cover 72.

Accordingly, work for installing the drive portion unit 13 can be easily carried out. Even when any defect occurs in the electromagnetic closing valve 14 within the drive portion unit 3, the water stop valve 61, the thermostat type mixing valve 15, or the control device 16 or the power supply device 17, whole or part of the drive portion unit 13 can be quickly and easily removed from the pipe 18 on the hot water side and the pipe 19 on the water side to quickly take adequate measure such as repair. After termination of the repair or the like, they can be quickly connected to the pipe 18 on the hot water side and the pipe 19 on the water side.

As described above, in the present embodiment, the execution and maintenance of the drive portion unit 13 can be materially improved.

Furthermore, as described above, since the drive portion unit 13 integrally encases not only the electromagnetic valve 14 but also the thermostat type mixing valve 15 and the water stop valve 61, a so-called drive portion for the automatic faucet A can be formed into a compact shape and the external appearance thereof can be also improved.

As shown in FIGS. 3 and 4, in the present embodiment, a dew drop preventing weir plate 72*h* is projected on the peripheral edge of a pipe leading opening 72*g* provided in a top plate 72*b* of the box-like cover 72, and only a portion in communication with the base plate 71 on the wall side of the weir plate 72*h* is cut to form an outflow opening 72*i*.

By the above-described construction, even when a dew drop occurs on the outer peripheral surface of the hot water supply pipe 12 connected to the third hot water supply internal pipe 77, the dew drop which moves along the top plate 72*b* of the box-like cover 72 into the control device 16 and the power supply device 17 is blocked to positively prevent from occurrence of trouble.

The construction of the control device 16 will be described with reference to FIGS. 4 to 9.

As will be apparent from FIG. 5, the base plate 71 on the wall side of the drive portion unit 13 is in the shape of an L-letter as viewed in plan, a part of which is extended into a control device connecting opening 72*f* of the box-like cover 72 to form a thick-wall partitioning wall 71*a*.

The partitioning wall 71*a* is integrally formed with a rectangular annular projection 71*b* over the entire peripheral edge of the control device mounting side.

Figure 6:
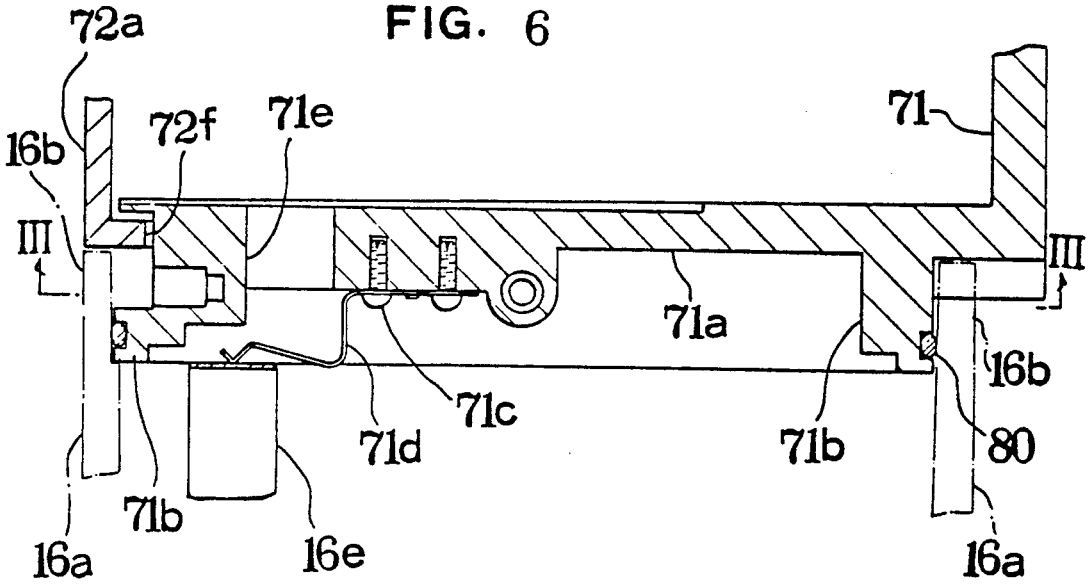
FIG. 6 is an enlarged sectional plan view of fitting portion of a control device to a drive portion unit.
Figure 7:
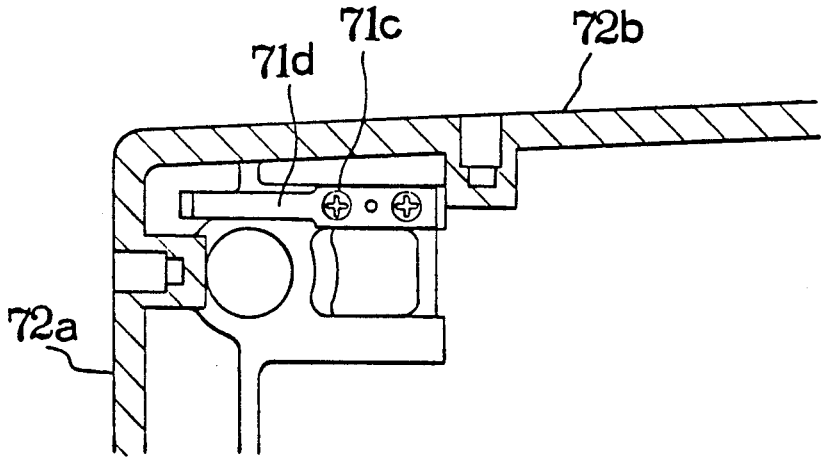
FIG. 7 is an enlarged sectional side view taken on line III—III of FIG. 6.

In the partitioning wall 71*a*, a contact 71*d* for an electromagnetic closing valve formed from a conductive plate which is thin and has an elasticity is secured to the side on the control device side by connecting screws 71*c*, as shown in FIGS. 5, 6, and 7.

One end of a lead wire 71*f* for an electromagnetic closing valve is connected to the contact 71*d* for an electromagnetic closing valve, and the other end of the lead wire 71*f* is connected to the electromagnetic closing valve 14 through a connection opening 71*e* opened to the partitioning wall 71*a*.

Reference numeral 71*g* designates a seal cap provided within the connection opening 71*e*.

On the other hand, the control device protective cover 16*a* forming an external portion of the control device 16 has a rectangular box shape, the partitioning wall 71*a* side of which is opened, and as shown in FIGS. 5, 6 and 7, an annular opening 16*b* on the partitioning wall side is removably fitted and engaged with a rectangular annular projection 71*b* of the partitioning wall 71*a*.

A packing 80 such as an O-ring is fitted in said fitting and engaging surface to secure water-tightness so as to prevent entry of water or the like into the drive portion unit 13 from outside.

In FIG. 5, reference numerals 80*a* and 80*b* designate a fixing screw and a fixing bolt provided to positively retain the aforesaid fitting and engagement.

By the aforementioned construction, the control device 16 and the power supply device 17 integral therewith can be easily and rapidly mounted on or disengaged from the drive portion unit 13 to materially improve the execution and maintenance.

Furthermore, since the water-tightness in the connection portion between the control device 16 and the drive portion unit 13 can be sufficiently secured, it is possible to positively prevent entry of water into the control device 16 and the power supply device 17, thus preventing trouble.

Next, the construction of the control device protective cover 16*a* will be described. A bracket 16*c* for mounting a control base plate is disposed at a position close to the partitioning wall 71*a*, and a control base plate 16*d* having a control portion 81 mounted on the upper surface thereof is mounted on the bracket 16*c*.

On one side end of the control base plate 16*d* is mounted an L-shaped contact 16*e* for an electromagnetic closing valve on the control device side, and when the control device protective cover 16*a* is removably fitted in and engaged with the rectangular annular projection contact 16*e* can contact with the contact 71*d* for an electromagnetic closing valve to electrically connect the control portion 81 with the electromagnetic closing valve 14.

In this manner, the control portion 81 can be connected to the electromagnetic closing valve 14 merely by mounting the control device 16 to the drive portion unit 13 without requiring any separate connecting work. Therefore, the execution and maintenance of the drive portion unit 13 can be materially improved.

As shown in FIG. 5, the other end of a sensor cord 37 with one end connected to a manual sensor 24 is connected with a terminal 16*f* provided on the other end of the control base plate 16*d*. A detection output can be positively sent from the manual sensor 24 to the control portion 81 by the sensor cord 37 to drive the electromagnetic closing valve 14.

In order to positively prevent entry of water into the control device 16 along the outer peripheral surface of the sensor cord 37, a seal ring 71*i* and a lid 71*j* are mounted within a sensor cord inserting opening 71*h* provided in the base plate 71 on the wall side, the seal ring 71*i* and the lid 71*j* being tightened by a tightening nut 71*k*.

Figure 9:
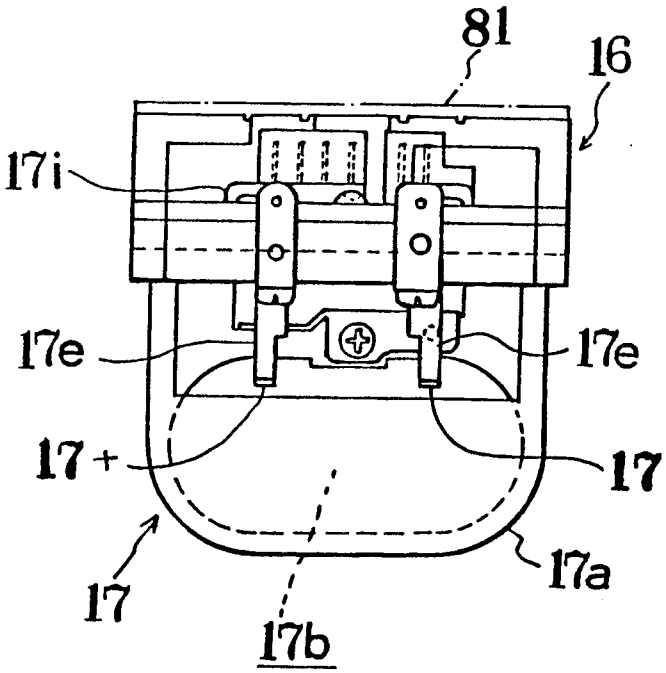
FIG. 9 is an arrowed side view taken along the line IV—IV of FIG. 8.
Figure 8:
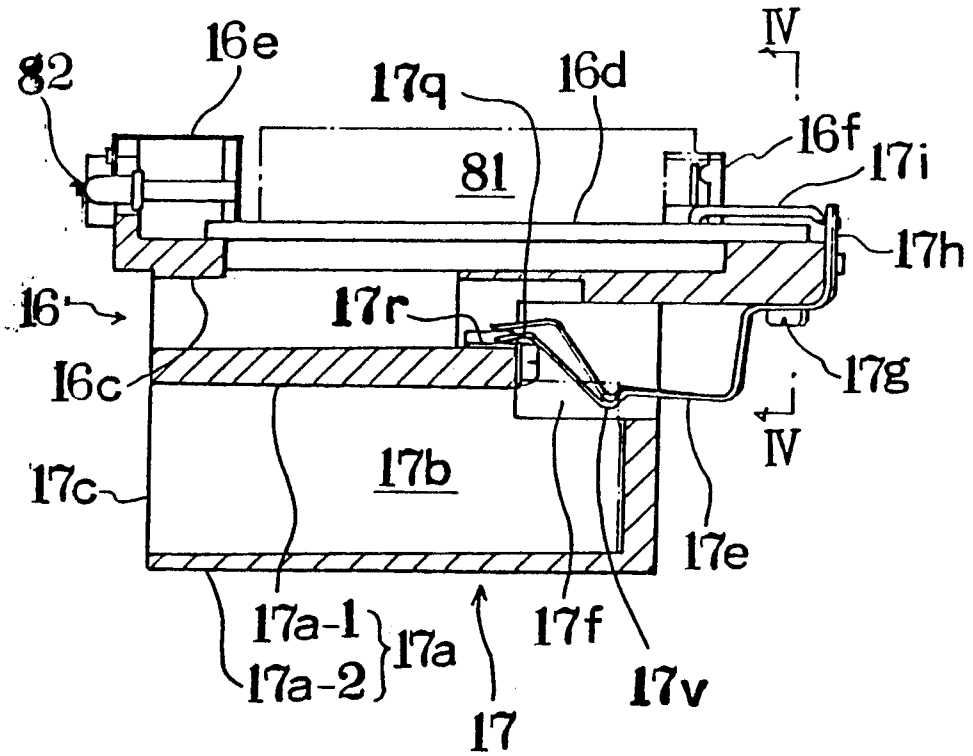
FIG. 8 is an enlarged sectional plan view of the interior of the control device.

The power supply device 17 will be now described. As shown in FIGS. 5, 8 and 9, a dry cell case 17*a* composed of a flat plate 17*a*-1 and an L-shaped plate 17*a*-2 is disposed approximately parallelly with the bracket 16*c* for mounting a control base plate within the control device protective cover 16*a*.

The dry cell case 17*a* is interiorly formed with a dry cell storing space 17*b*, on one end of which is provided an opening 17*c* for mounting a dry cell and on the other end of which is provided an opening 17*f* for guiding connection of contact for connecting both poles of the dry cell 17*d* stored in the dry cell storing space 17*b* to a dry cell contact 17*e* to be described hereinafter.

That is, the dry cell contact 17*e* is composed of a conductive plate which is thin and has an elasticity, as shown in FIGS. 8 and 9, a base of which is secured to the inside on one end side of the bracket 16*c* for mounting a control base plate by means of a connecting pin 17*g*.

On the other hand, an end of the dry cell contact 17*e* is disposed facing to the opening 17*f* for guiding connection of contact of the dry cell case 17*a*, and when the dry cell 17*d* is stored into the dry cell storing space 17*b*, the said end automatically comes into contact with both poles of the dry cell 17*d* to render them conductive.

As shown in FIGS. 8 and 9, an extension 17*h* is provided on the base end of the dry cell contact 17*e*, and the end of the extension 17*h* is connected to a conduction guide plate 17*i* provided on the control base plate 16*d*.

Accordingly, when the dry cell 17*d* is mounted within the dry cell storing space 17*b*, power can be supplied to the control device 16 through the dry cell contact 17*e*, and power can be supplied also to the electromagnetic closing valve 14 through the aforementioned contacts 16*e* and 71*d* for an electromagnetic cloing valve.

As shown in FIGS. 8 and 9, the dry cell case 17*a*, the bracket 16*c* for mounting a control base plate and the control base plate 16*d* are integrally formed in the state where the contact 16*e* for an electromagnetic closing valve and the dry cell contact 17*e* are assembled, which, in that form, can be incorporated into the control device protective cover 16*a*.

Accordingly, the assembling and maintenance of the control device 16 and the power supply device 17 can be improved.

As shown in FIGS. 4 and 5, a rectangular opening 17*j* in communication with the dry cell storing space 17*b* is provided frontwardly of the control device protective cover 16*a*, and a lid 17l having a circular dry cell mounting opening 17*k* in the central portion thereof is removably mounted on the rectangular opening 17*j* by means of a connecting bolt 17*m*.

A dry cell fixing plate 17*n* is integrally connected to the upper portion at the rear end of the dry cell 17*d* stored into the dry cell case 17*a* through the opening 17*k* for mounting the dry cell, the plate 17*n* being removably connected to the lid 17l by means of a fixing bolt 17*o*.

Accordingly, replacement of the dry cell 17*d* can be easily accomplished merely by loosening the fixing bolt 17*o* to remove it together with the dry cell fixing plate 17*n*, mounting the dry cell fixing plate 17*a* on the rear portion of a new dry cell 17*d*, thereafter storing the dry cell 17*d* into the dry cell storing space 17*b* through the opening 17*k* for mounting a dry cell, and connecting the dry cell fixing plate 17*n* to the lid 17l by the fixing bolt 17*o*.

As shown in FIGS. 4 and 5, a power-off display lamp 82 such as an LED is connected to one side of the control base plate 16*d*, and a transparent window 83 for facilitating vision from the outside is provided on the front wall of the control device protective cover 16*a* ahead of the display lamp 82.

Accordingly, when a power output of the dry cell 17*d* drops to a level below a predetermined voltage, a comparator or the like is used to detect it so that the power-off display lamp 82 formed from LED or the like can be quickly flickered to quickly inform a maintenance person of a user or time for replacement of the dry cell 17*d*.

Alternatively, when power drops to a level below a predetermined voltage, the machine in the system is temporarily stopped to flicker the power-off display lamp 82 formed from LED or the like so that a maintenance person or a user may pay attention thereto.

In the above-described embodiment, the power supply device 17 uses the dry cell 17*d* so that a low voltage is supplied to the electromagnetic closing valve 14 or the manual sensor 24 therefrom. Therefore, trouble such as an electric shock can be positively prevented.

A further construction of the automatic faucet A in the present embodiment will be described hereinafter.

First, the construction of the spout 11 will be described in detail with reference to FIGS. 3 and 10 to 16.

A feature of the spout 11 substantially resides in the construction in which a protective cover 22 for a sensor or the like formed of a synthetic resin material such as plastics is removably mounted on the inside of the spout body 21 casting having a discharge water flow path 20 formed integral with the wall, and a fitting space S for the sensor or the like is formed between the spout body 21 and the protective cover 22 for the sensor or the like to store a manual sensor 24 or the like therein, as shown in FIG. 3.

In the above-described construction, the construction of the spout body 21 will be first described. As shown in FIGS. 2 and 3, the spout body 21 has its base end side secured to a place surface 10 at the inner part of a washbowl 10, and an extreme end thereof directed frontwardly of the bowl 10 and extended in an upwardly inclined state.

Figure 10:
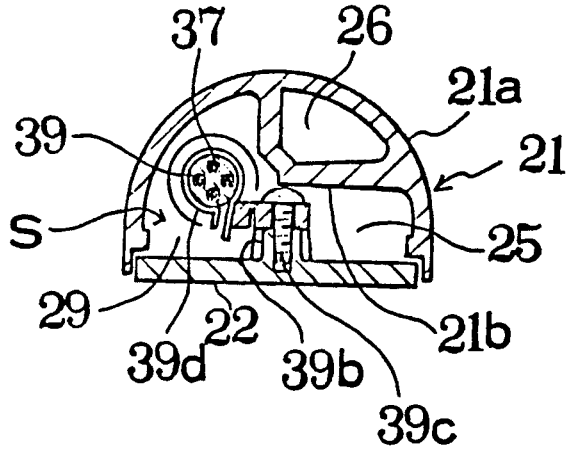
FIGS. 10 to 12 are cross-sectional views of a spout body taken on lines V—V, VI—VI and VII—VII, respectively, of FIG. 3.

As shown in FIG. 10, the spout body 21 is formed with a lengthy space 25 having an approximately semicircular section over all length thereof, and a part of the lengthy space 25 is divided by a part of an upper wall 21*a* and an L-shaped partitioning wall 21*b* to form a discharge water flow path 20.

The lengthy space 25 provided interiorly of the spout body 21 can cooperate with the protective cover 22 for the sensor or the like described later to form a fitting space S for the sensor or the like previously mentioned.

The construction of the extreme end of the spout body 21 will be described hereinafter with reference to FIG. 3. On the extreme end are provided a front wall 26 and a crossing partitioning wall 27 spaced apart from the front wall 26. Between the front wall 26 and the crossing partitioning wall 27, a manual sensor 24 is stored in the sensor fitting space 28.

On the other hand, at the rear of the crossing partitioning wall 27 is formed a sensor cord storing space 29 extending to the base end of the spout body 21, as shown in FIGS. 3 and 10.

That is, the fitting space S for the sensor or the like is constituted by the sensor fitting space 28 and the sensor cord storing space 29.

In the spout body 21, the extreme end of the L-shaped partitioning wall 21*b* forming the discharge water flow path 20 is bent downwardly at the rear position spaced from the crossing partitioning wall 27 to cooperate with the crossing partitioning wall 27 to form a cylindrical opening 30, as shown in FIG. 3.

A water discharge cap 30*a* is removably threadedly mounted within the cylindrical opening 30.

The construction of the base portion of the spout body 21 will be described. The aforesaid base portion is composed of a semicircular rear wall 21*c* and a pair of frontwardly extending walls 21*d* and 21*d* frontwardly extending parallel with each other from the both front ends of the rear wall 21*c*, as shown in FIGS. 3 and 11.

Figure 11:
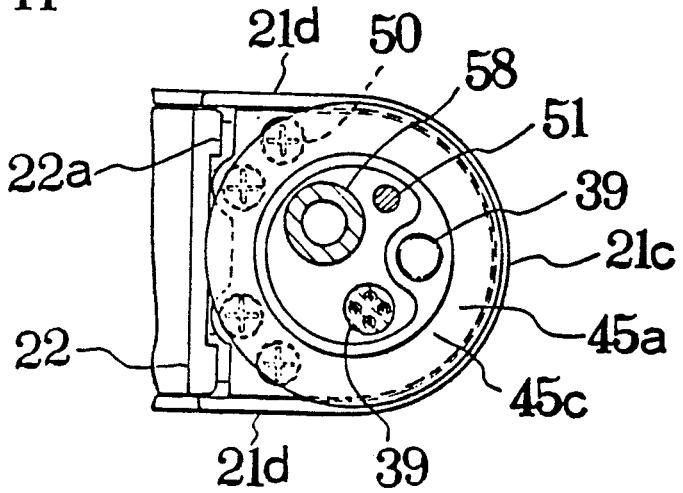

The base portion of the spout body 21 cooperates with a base portion 22*a* of the protective cover 22 for the sensor or the like to form a cylindrical spout fitting portion, as shown in FIG. 11.

Next, the construction of the protective cover 22 for the sensor or the like will be described. The protective cover 22 is formed from a thin lengthy flat plate formed of a synthetic resin material and removably mounted on the inside of the spout body 21 to thereby form a spout 11, as shown in FIG. 3.

In the present embodiment, the mounting of the protective cover 22 for the sensor or the like is carried out by threadedly connecting the extreme end and the central portion of the protective cover 22 for the sensor or the like to a boss portion 33 at the extreme end and a central boss portion 34 of the spout body 21 by connecting screws 31 and 32, respectively, as shown in FIG. 3.

As shown in FIG. 3, the protective cover 22 for the sensor or the like is provided in its extreme end with a through-hole 35 for the sensor for exposing a sensor block 24*a* of the manual sensor 24 to outside and at a position spaced rearwardly of the through-hole 35 for the sensor with a cylindrical opening with the water discharge cap 30*a* threadedly mounted thereon, that is, a water discharging opening 36 for exposing a water discharge port 30 to outside.

Further, as shown in FIG. 11, the base portion 22*a* of the protective cover 22 for the sensor or the like is in the form of a flat plate, which cooperates with the rear wall 21*c* of the spout body 21 as previously mentioned to form a water-tight cylindrical spout fitting portion. By this construction, the protective cover 22 for the sensor or the like is connected to the spout body 21 in a water-tight state over the overall length thereof.

Since the fitting space S for the sensor or the like is not in a completely water-tight state, it is designed so that a weir 100 is provided, and moved-in water escapes from both sides of the protective cover 22 or from a clearance between the base portion 22*a* of the protective cover for the sensor or the like and an upper portion defining ring 45 described later.

Next, a manual sensor 24 disposed in the fitting space S for the sensor or the like formed between the spout body 21 and the protective cover 22 for the sensor or the like and a sensor cord 37 for connecting the manual sensor 24 with the control device 16 will be described with reference to FIGS. 3, 13 and 14.

First, the construction of the manual sensor 24 will be described. As shown in FIG. 13, a sensor mounting space 38 with a through-hole 35 for the sensor opened to the lower surface thereof is formed in the upper surface at the extreme end of the protective cover 22 for the sensor or the like.

Within the sensor mounting space 38, a sensor block 24*a*, a sensor base plate 24*b* for connecting one end of the sensor cord 37 described later and a transparent plate 24*c* are integrally molded, by resin mold agent 24*d* such as epoxy resin, within a sealed box in the shape of a rectangular box composed of a rectangular cylindrical sensor case 24*e* and a case cover 24*f*.

In the above-described construction, the sensor block 24*a* is interiorly provided with sensor element fitting holes 24*g* and 24*h* in a spaced relation, and a projection element 24*i* formed from a phototransistor the base end of which is connected to the sensor base 24*b* and a light receiving element 24*j* formed from a photodiode are mounted within the fitting holes 24*g* and 24*h*.

When infrared ray emitted from the projection element 24*i* and reflected by the hand is received by the light receiving element 24*j*, the manual sensor 24 generates a detection output to send an output signal to the control device 16, to drive the electromagnetic closeing valve 14 and to automatically discharge hot water from the discharge water cap 30*a*.

As described above, in the present embodiment, since the manual sensor 24 and the sensor cord 37 connected to the sensor 24 are substantially disposed within a resin mold construction, it is possible to positively prevent entry of water to the sensor block 24*a* and the sensor base plate 24*b* and erroneous operation of the manual sensor 24.

Since the sensor direction $D_1$ of the manual sensor 24 is parallel with the discharge water direction $D_2$ of the discharge water port 30, the manual sensor 24 will not detect a discharge water flow but the erroneous operation can be positively prevented, as shown in FIG. 3.

Moreover, since as shown in FIG. 3, the manual sensor 24 is provided on the extreme end side spaced from the discharge water port 30, when hands reach out toward the discharge water port 30, the manual sensor 24 first detects it and actuates, after which water is turned on quickly. On the other hand, after the hands have been completely withdrawn from the discharge water port 30 after cleaning, the manual sensor 24 generates an off-output to quickly stop the water discharge.

Accordingly, the using convenience of the automatic faucet A can be materially improved.

Next, the construction of the sensor cord 37 for connecting the manual sensor 24 having the aforesaid construction to the control device 16 will be described.

Figure 13:
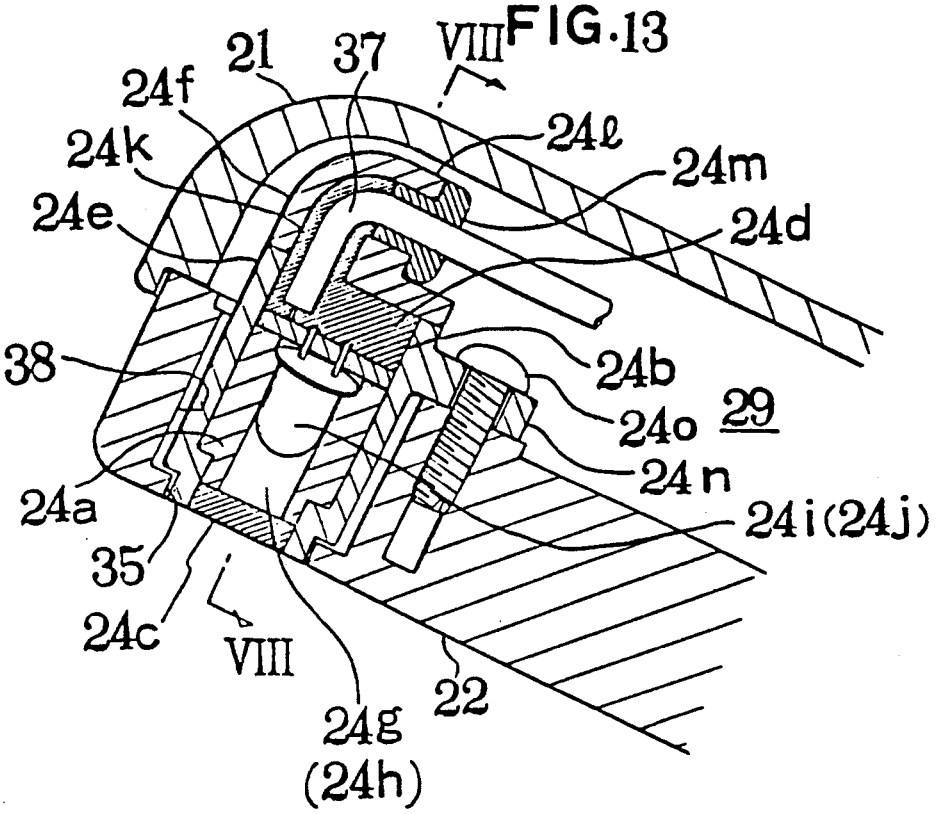
FIG. 13 is a view for explaining the fitting state of a manual sensor at the extreme end of the spout body.
Figure 14:
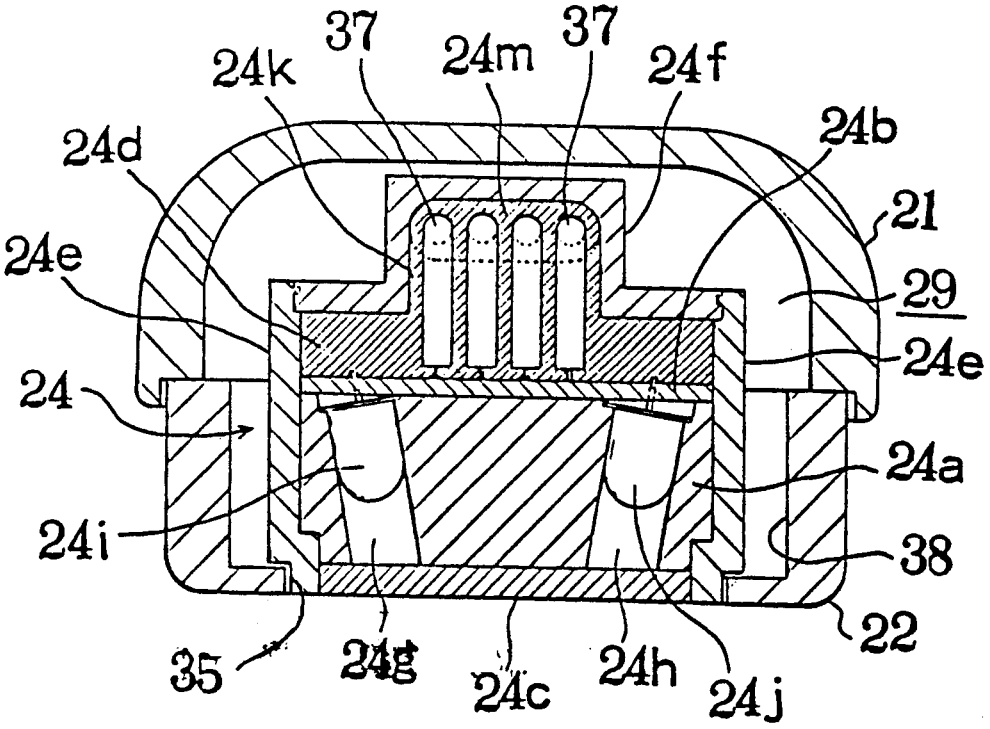
FIG. 14 is a cross-sectional view of a manual sensor taken on line VIII—VIII of FIG. 13.

As shown in FIGS. 13 and 14, one end of a plurality of sensor cords 37 is connected to the upper surface of the sensor base plate 24*b*, and the other end of the sensor cord 37 extends into the sensor cord storing space 29 formed between the spout body 21 and the protective cover 22 for the sensor or the like through a sensor cord leading path 24*k* provided interiorly of the case cover 21*f* and thereafter is connected to the control device 16 through the cylindrical metal fitting portion of the automatic faucet A.

In the construction as described above, as shown in FIGS. 13 and 14, a rubber bushing 24*m* is introduced under pressure against the resilient force thereof into a sensor cord leading end 241 of the sensor cord leading path 24*k*, and one end of the sensor cord 37 is embeded into a resin mold agent 24*d*.

Accordingly, the cooperation between the aforesaid resin mold construction and the rubber bushing 24*m* can improve the contactness between the sensor cord 37 and the resin mold agent 24*d*, materially improve the water resistance of the manual sensor 24 and more positively prevent the erroneous operation of the manual sensor 24.

In the present embodiment, the sensor case 24*e* has a support bracket 24*n* extended rearwardly from the rear wall as shown in FIG. 9, the bracket 24*n* being secured in a cantilever fashion to the protective cover 22 for the sensor or the like by means of a fixing bolt 24*o*.

The plurality of sensor cords 37 are extended into the sensor cord storing space 29 and thereafter encircled integrally by a sensor cord protective cable 39, the protective cable 39 being connected to the control device 16 through the base portion of the spout 11, as shown in FIG. 3.

The sensor cord protective cable 39 has a water return ring 39*a* mounted at the rear of the sensor cord storing space 29, as shown in FIG. 3. By the provision of the ring 39*a*, it is possible to positively prevent scattered water or the like entered into the sensor cord storing space 29 from moving along the outer peripheral surface of the sensor cord protective cable 39 and reaching the control device 16 to produce a defective control.

As shown in FIG. 10, the sensor cord protective cable 39 is removably supported on a sensor cord fitting device 39*d* secured by means of a connecting screw 39*c* to the upper surface of a support post 39*b* stood upright in the central portion of the protective cover 22 for the sensor or the like. Accordingly, the sensor protective cable 39 can be positioned considerably above the upper surface of the protective cover 22 for the sensor or the like along which scattered water flows, and in view of this, the water resistance with respect to the sensor cord 37 can be achieved.

Referring now to FIG. 3, a hot water supply pipe construction will be described in which hot water is supplied from a hot water supply flow path 40 formed in the drive portion unit 13 to a discharge water flow path 20 formed in the spout body 21 of the spout 11.

As shown in FIG. 3, the spout 11 is provided in its base end with a cylindrical threaded portion 41*a* connected in communication to the lower part of the discharge water flow path 20.

An upper end of a discharge water flow path connecting pipe 41 is threadedly mounted on the cylindrical threaded portion 41, and the lower end of the connecting pipe 41 extends through a spout fitting opening 42 provided at the place surface 10*a* in the inner part of the bowl 10 and at a position immediately below the base end of the spout 11 to be extended downwardly.

The lower end of the discharge water flow path connecting pipe 41 is connected to the side end at downstream of the hot water supply pipe 12 in a water-tight state by use of a union 43, whereas the side end at upstream of the hot water supply pipe 12 is connected to an opening at downstream of the hot water supply flow path 40 formed within the drive portion unit 13.

With this construction, when the electromagnetic closing valve 14 is driven, the mixed hot water can be supplied quickly to the discharge water flow path 20 through the hot water supply flow path 40, the hot water supply pipe 12, the discharge water flow path connecting pipe 41.

Referring now to FIGS. 3, 11, 12 and 15, a spout fixing construction will be described in which the spout 11 is secured to the place surface 10*a* in the inner part of the bowl 10.

Figure 15:
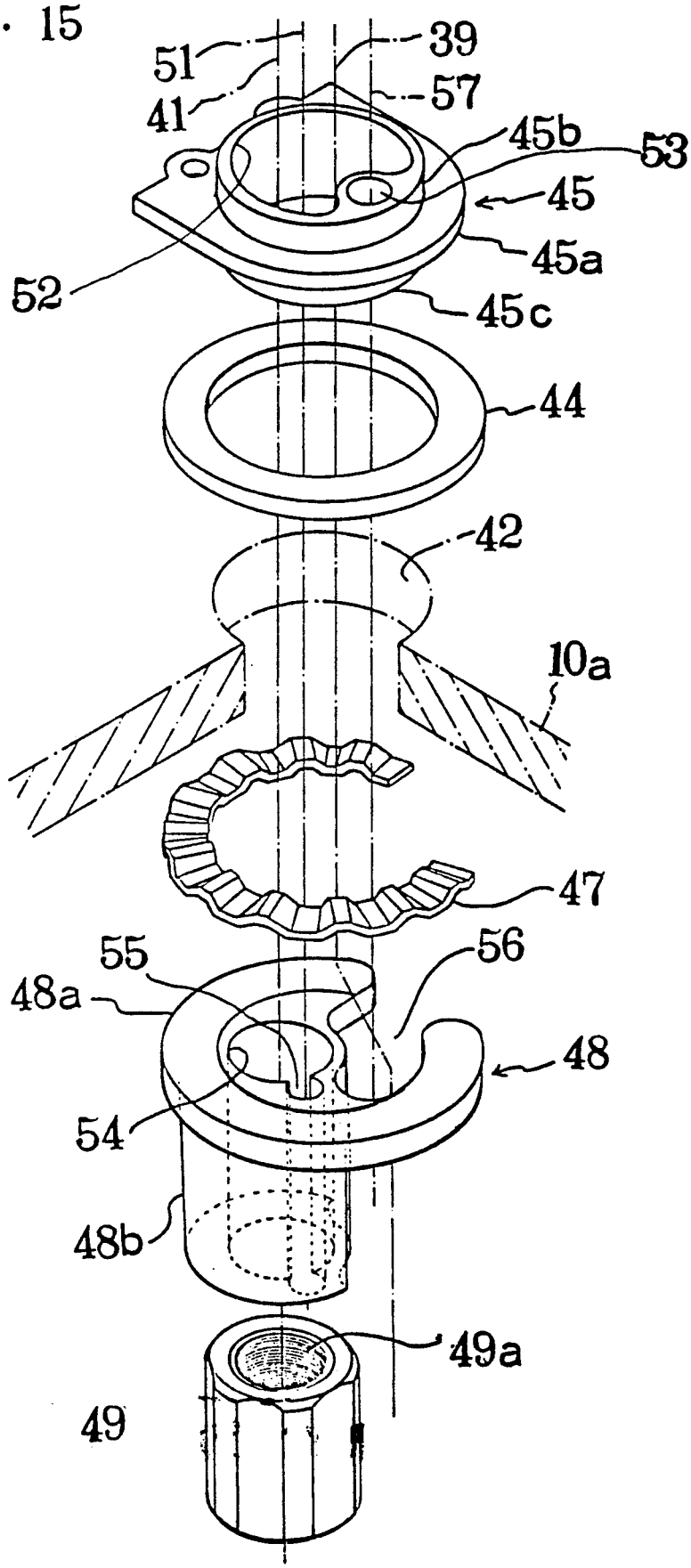
FIG. 15 is an exploded perspective view of a locking construction of the spout body.

As shown in FIGS. 3 and 15, the spout fixing construction is substantially composed of an upper seal ring 44 and an upper defining ring 45 provided in a superposed state above the spout fitting opening 42 provided in the place surface 10*a* in the inner part of the bowl 10, a shake proof washer 47 provided in a superposed state below the spout fitting opening 42, a lower fitting washer 48, and a fastening nut 49.

In the above-described construction, the upper defining ring 45 is composed of an annular collar 45*a* provided in the central outer peripheral edge thereof, a spout fitting portion 45*b* and a washbowl fitting portion 45*c* formed above and below, respectively, thereof, as shown in FIG. 15.

As shown in FIG. 3, the spout fitting portion 45*b* is fitted to the base portion of the spout 11 and is integrally connected by a connecting bolt 50 as shown in FIG. 7. On the other hand, the bowl fitting portion 45*c* is fitted into the spout fitting opening 42 provided in the bowl 10 to positively locating a fitting position of the spout 11.

As shown in FIG. 15, the upper defining ring 45 is provided with a heart-shaped irregular through-hole 52 through which extend the discharge water flow path connecting pipe 41, the sensor cord protective cable 39 and a guide pin 51 described later. A through hole 53 for a pop-up type drain plug operating rod is provided at a position adjacent to the through-hole 52.

Further, as shown in FIG. 15, the lower fitting washer 48 is composed of an upper spread collar 48*a* having a horse-shoe shape, and a lower cylindrical portion 48*b* integrally connected at an eccentric position from the center on the inside of the collar 48*a*.

Figure 12:
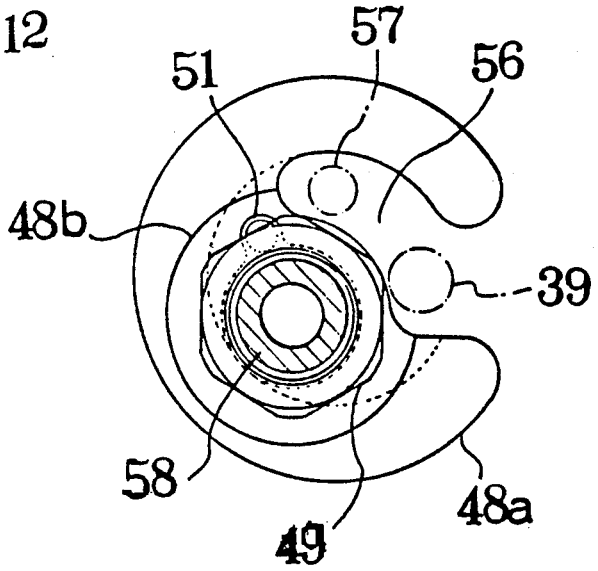

The lower fitting washer 48 is provided in its eccentric position from the center with a large-diameter through-hole 54 through which is inserted the discharge water flow path connecting pipe 41 and a small-diameter through-hole 55 through which is inserted a guide pin 51 described later, as shown in FIGS. 12 and 15.

The lower fitting washer 48 is further provided in the peripheral edge of the upper spread collar 48*a* with a circular cutaway space 56 one end of which is opened to outside, as shown in FIG. 15, and the sensor cord 37 and a pop-up type drain plug operating rod 57 are inserted into the space 56, as shown in FIG. 3.

Next, a work for fixing the spout body 11 to the bowl 10 in the spout fixing construction having the above-described construction will be described with reference to FIGS. 3, 15 and 16.

First, the upper defining ring 45 is fitted, connected and fixed to the base end of the spout body 11 with the sensor and cord protective cable 39 for protecting the manual sensor 24 and the sensor cord 37 incorporated therein in advance, as shown in FIGS. 3 and 15 to 18, and the upper end of the discharge water flow path connecting pipe 41 and the upper end of the guide pin 51 are threadedly fitted to the cylindrical threaded portions 14*a* (FIG. 3) and 41*b* (FIG. 16) provided in the base end of the spout body 11.

Figure 16:
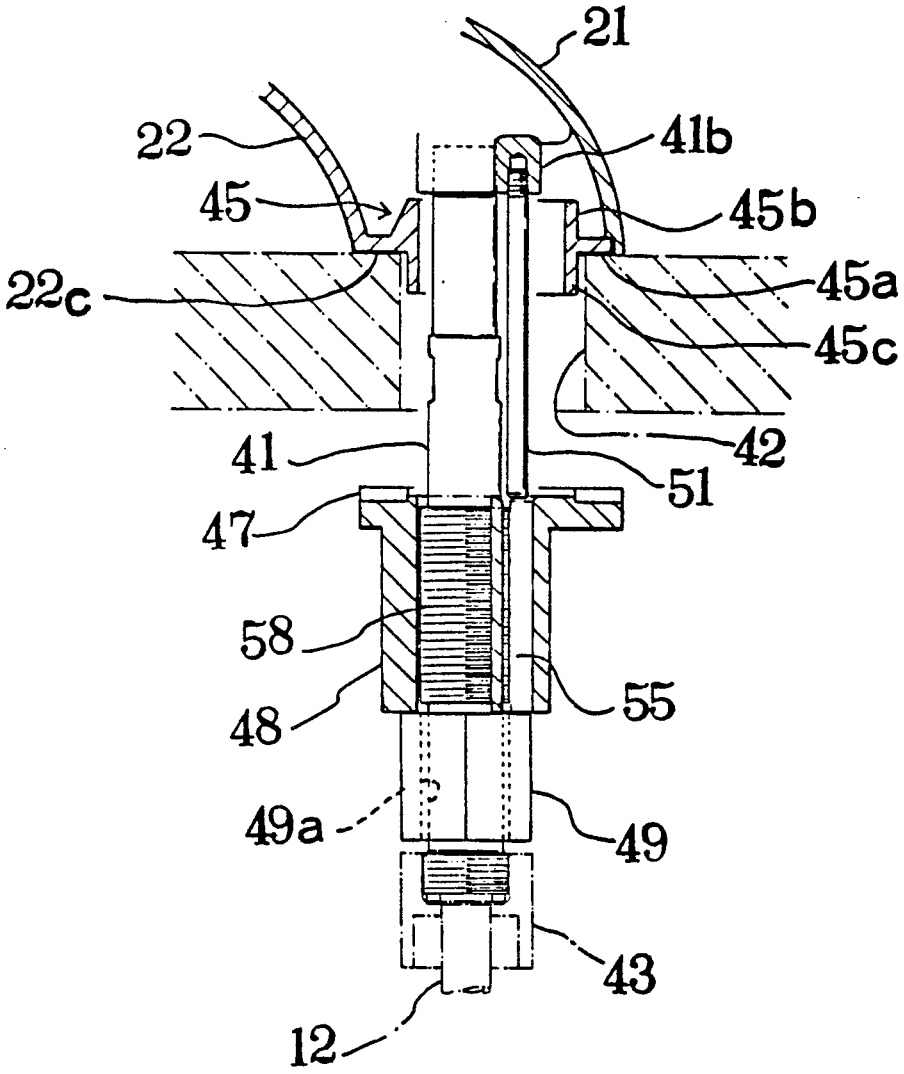
FIG. 16 to 18 are explanatory views, respectively, of a work for locking a spout body.

After completion of the above-described connection and fixing work, as shown in FIG. 16, the discharge water flow path connecting pipe 41 is made to extend through the spout fitting opening 42 provided in the bowl 10, and the lower fitting portion 45*c* of the upper defining ring 45 is fitted into the spout fitting opening 42 through the upper seal ring 44.

On the other hand, the shake proof washer 47, the lower fitting washer 48 and the fastening nut 49 are fitted in order into the outer peripheral surface of the discharge water flow path connecting pipe 41 from the lower end of the latter, and the guide pin 51 is made to extend through the pin insert hole 55 provided in the lower fitting washer 48.

Subsequently, the fastening nut 49 is turned to engage an internal threaded hole 49*a* with an external threaded portion 58 provided in the outer peripheral surface in the midst of the discharge water flow path connecting pipe 41, as shown in FIG. 16.

Thereafter, when the fastening nut 49 is continuously turned, the lower fitting washer 48 is to be moved upward since the washer 48 cannot be rotated due to the presence of the guide pin 51.

Figure 17:
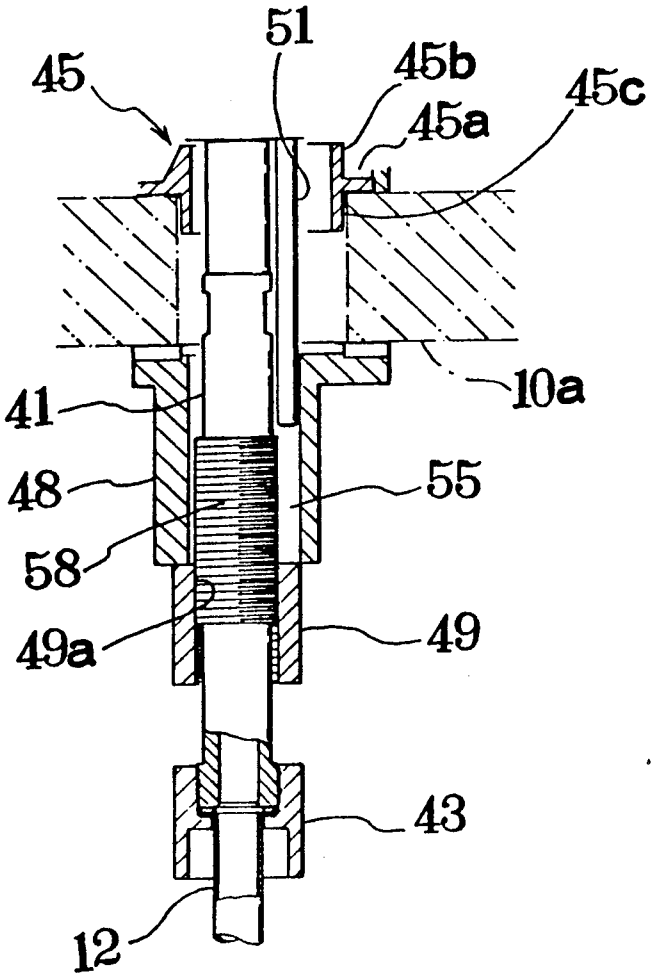

When the fastening nut 49 is further continuously turned, the lower seal ring 46 and the shake proof washer 47 are pressed against the mounting surface 10*a* in the inner part of the bowl 10, as shown in FIG. 17.

Thereby, the upper defining ring 45 is powerfully secured to the bowl 10, and the spout 11 integral with the upper defining ring 45 is also powerfully secured to the bowl 10.

In the fixing work as described, since the lower fitting washer 48 has a horse-shoe shape and is provided with the circular cutaway space 56 one end of which is opened, as shown in FIGS. 8 and 11, the sensor and cord protective cable 39 can be fitted in and engaged with the circular cutaway space 56 from the outer side, and the spout fixing work can be very easily carried out despite the presence of the protective cable 39.

In the above-described fixing work, since at the time of mounting the lower fitting washer 48 to the discharge water flow path connecting pipe 41, the washer guiding guide pin 51 extended downward from the base of the discharge water metal 11 can be inserted into the pin insert hole 55 provided in the lower fitting washer 48, the lower fitting washer 48 remains immovable even by thereafter movement of the fastening nut 49. Accordingly, it is possible to positively prevent engagement of the sensor cord 37 caused by the immovable lower fitting washer 48 between the lower surface of the place surface 10*a* in the inner part of the bowl 10 and the upper surface of the lower fitting washer 48 or the shake proof washer 47, and prevent the sensor cord 37 form being broken.

Since the cutaway space 56 provided in the lower fitting washer 48 can be positioned in a given direction at which the sensor cord 37 is easily drawn out, it is possible to prevent the sensor cord 37 from being twisted, and it is possible to easily carry out a work for drawing the sensor cord 37.

Furthermore, in the present embodiment, the relative positional relationship between the external threaded portion 58 provided in the outer peripheral surface of the discharge water flow path connecting pipe 41 and the washer guiding guide pin 51 is set so as not to threadedly engage with the internal threaded hole 49*a* of the fastening nut 49 till the washer guiding guide pin 51 is inserted into the pin insert hole 55. Therefore, it is possible to positively prevent occurrence of erroneous execution to position the cutaway space 56 to an accurate sensor cord drawing position.

Figure 18:
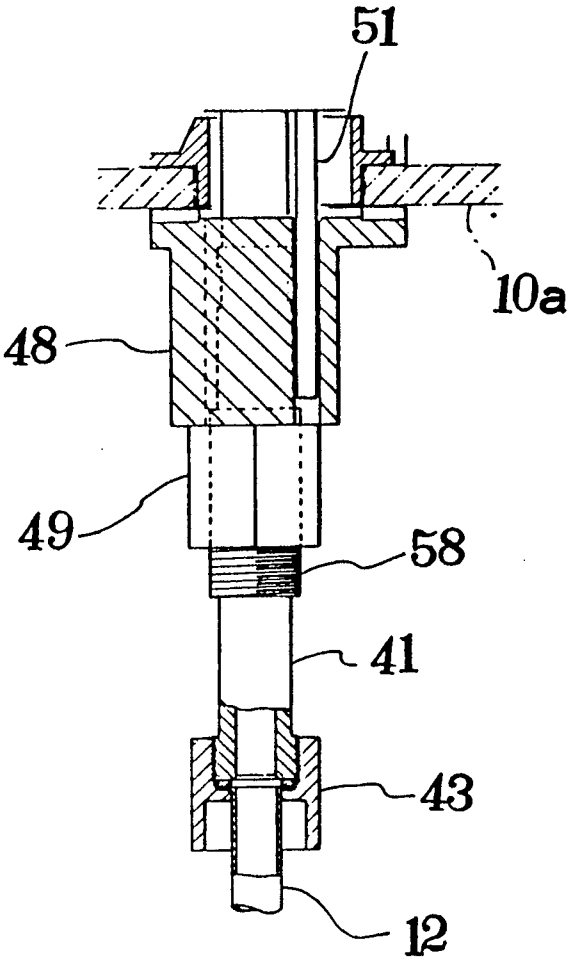

Since in the present embodiment, the pin insert hole 55 provided in the lower fitting washer 48 has a length enough to insert the washer guiding guide pin 51, even if the spout fitting plate such as the mounting surface 10*a* in the inner part of the bowl 10 is thin as shown in FIG. 18, it is possible to positively guide vertically moving operation of the lower fitting washer 48 to firmly fix the spout 11 to the discharge water fitting plate, and prevent trouble such as a breakage of the sensor cord 37.

After completion of the above-described fixing work, the lower end of the discharge water flow path connecting pipe 41 is connected in a water-tight state to the side end at upstream of the hot water supply pipe 12 by use of a box nut 43.

As shown in FIG. 3, the pop-up type drain plug operating rod 57 is extended downward through the small-diameter through-hole 59 provided in the base of the metal 11, the, through-hole 53 for the pop-up type drain plug operating rod provided in the upper defining ring 45, the upper seal ring 44, the discharge water metal fitting opening 42, the shake proof washer 47, and the circular cutaway space 56 of the lower fitting washer 48, and the extended end thereof is operatively connected to a pop-up drain plug not shown.

Next, the automatic faucet A having the above-described configuration will be described hereinafter.

As previously mentioned, the dry cell 17*d* is mounted on the dry cell case 17*a* whereby a low voltage is supplied to the electromagnetic closing valve 14 and the manual sensor 24 to render the automatic faucet in an initial state.

When a user reaches out downwardly of the discharge water cap 30*a* positioned at the extreme end of the automatic faucet A after attending to one's business, the manual sensor 24 issues an ON-output. The control devide 16 sends a drive signal to the electromagnetic closing valve 14 on the basis of the on-output to drive the electromagnetic closing valve 14 whereby the plunger 14*c* is moved backward and the valve body 14*a* is moved away from the valve seat 14*b* to open the valve, as shown in FIG. 3.

Thereby, the mixed hot water at a moderate temperature adjusted by the thermostat type mixing valve 15 is supplied to the discharge wate flow path 20 through the hot water supply flow path 40, the hot water supply pipe 12, the discharge water flow path connecting pipe 41, after which the hot water is discharged out of the discharge water cap 30*a* so that hands can be cleaned.

After completion of cleaning, when a user draws his hand, the manual sensor 24 does not detect the hands any longer. It sends an OFF-output to the control device 16. The control devide 16 causes the plunger 14*c* of the electromagnetic closing valve 14 to move forward on the basis of the OFF-output to bring the valve body 14*a* into contact with the valve seat 14*b* to open the valve.

In the above-described operation, in the case where the electromagnetic closing valve 14 is subjected to latching solenoid driving, the elctromagnetic closing vavle 14 is driven to open or close the valve, after which even if power is not supplied, opening or closing state of the valve can be self-maintained to save power.

In the present embodiment, the water resistance of the electromagnetic closling valve 14 and the control portion 81 can be attained by mounting them in the drive portion unit 13 and the control device protective cover 16, and thereafter fitting and connecting the control device protective cover 16*a* to the drive portion unit 13 in a water-tight state.

In the fitting and connection as described, a packing 80 such as an O-ring is provided in the fitting portion to provide a complete water-tightness.

Accordingly, since the electromagnetic closing valve 14 and the control portion 18 need not be independently water proof construction, the water proof construction becomes simple so that the number of parts can be reduced, the device can be manufactured at less cost, and the execution can be improved. Furthermore, the control device protective cover 16*a* can be removed from the drive portion unit 13 to facilitate the repairing work. Therefore, maintenance such as adjustment of sensing length of the manual sensor 24 can be also improved.

While the present invention has been described with reference to the embodiments, it is to be noted that the scope of the present invention is not limited to those described above. For example, as shown in FIGS. 2 and 3, a how-to-use display plate 101 can be mounted on the surface of the discharge water metal 11 and on the front wall 26 of the metal main body 21 which attracts user's attention. In this case, a user of the automatic faucet A irrespective of an ordinary person as well as an infant and the old can easily and positively recognize the how-to-use displayed on the how-to-use display plate 101, which can be used easily and accurately.

Figure 19:
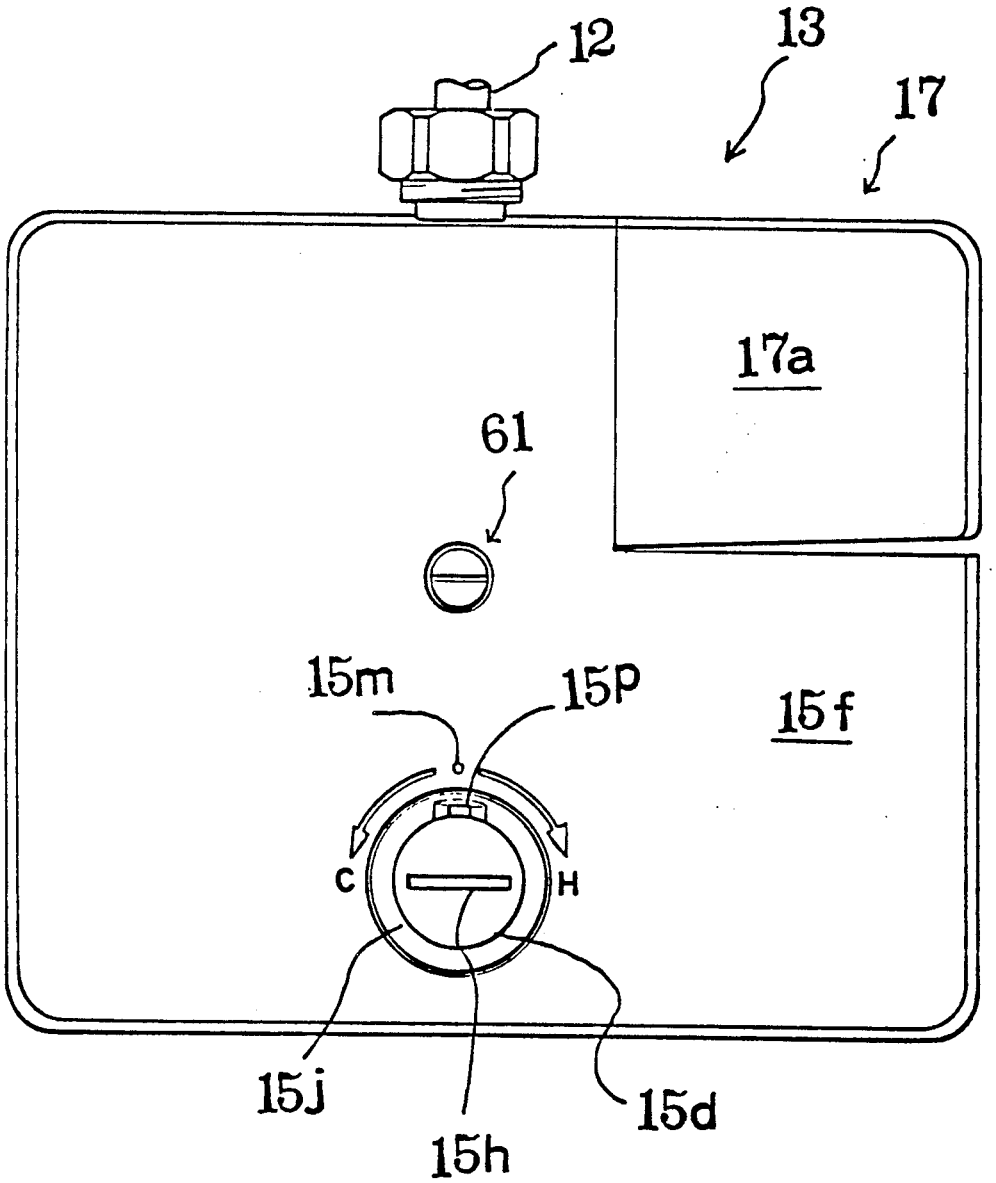
FIG. 19 is an explanatory view of an operating portion of a thermostat type mixing valve.
Figure 20:
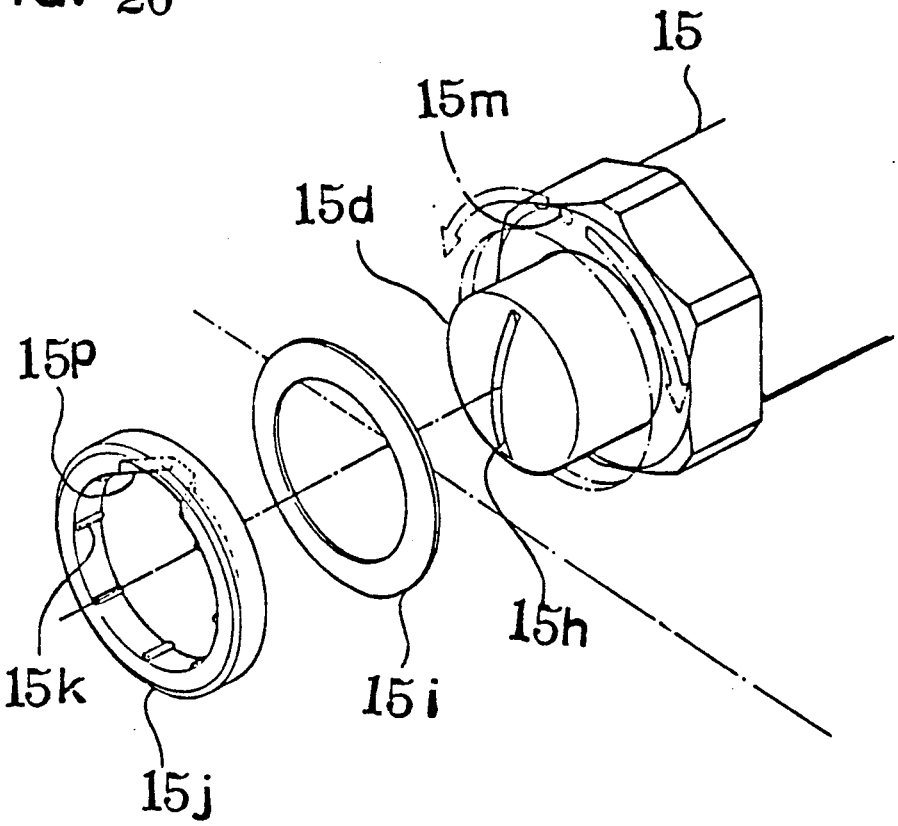
FIG. 20 is an exploded perspective view of the same.

As shown in FIGS. 3, 19, and 20, the mixing valve 15 is designed so that a temperature setting screw 15*d* is exposed to the front surface of a front panel 15*f* of the casing encasing therein the mixing valve 15, a collar ring 15*i* is fitted into the temperature setting screw 15*d* from the outside, a cover ring 15*j* formed with a projection 15*k* on the inner peripheral surface and a notch 15*p* extending from the surface to the inside is fitted on the outside of the collar ring 15*i*, the cover ring 15*j* is secured to the temperature setting screw 15*d* with interference of the temperature setting screw 15*d* and the projection 15*k*, and a part of the collar ring 15*i* is made visible from the outside through the notch 15*p*.

With the construction as described, a mark can be provided on the side of the cover ring 15*j* having a good appearance merely by providing the collar ring 15*i* and the ring 15*j* over the temperature setting screw 15*d*. Since the position of the notch 15*p* can be adjusted freely, the mark on the side of the temperature setting screw can be registered with the mark on the side of the front panel.

In FIGS. 3, 19 and 20, reference numeral 15*g* denotes a screw insert hole, 15*h*, a circular groove for insertion of a tool such as a driver or a coin, 15*m* a mark of the front panel 15*f* of the drive portion unit 13, 15*n* a seal member, and 15*o* a spring for biasing a thermostat 15*c* in a direction of the valve seat 15*e*.

As shown in FIGS. 5, 8 and 9, in the power supply device 17, a short-circuit plate 17*r* is attached to the upper surface in the inner part of the flat plate 17*a*-1 so as to oppose to a contact portion 17*q* extended to the extreme end of a dry cell contact 17*e*. When the dry cell 17*d* is mounted, an abutment 17*v* placed in abutment with the inner end of the dry cell 17*d* and raised upward to release the contact between the short-circuit plate 17*r* and the dry cell contact 17*e* to prevent the dry cell 17*d* from being short-circuited. In the state that the dry cell 17*d* is not mounted, the contact protion 17*q* comes into contact with the short-circuit plate 17*r* to short-circuit + − of the contact 17+, 17− to erase a charge of the control base plate 16*d*.

Accordingly, a charge such as static electricity is prevented from being applied to IC or the like to prevent the IC or the like from being damaged.

Although not shown, in the drive portion unit 13, a dry cell drawing rod is provided on a lid of the dry cell case 17*a* encasing the dry cell 17*d*, and the contact portion is extended to an input terminal of power supply of the control base plate 16*d* of the control device 16 so that when the dry cell 17*d* is drawn, the contact portion comes into contact with the dry cell drawing rod to erase the charge of the control device 16.

Alternatively, in the state where the dry cell 17*d* is not mounted, both poles of the input terminal of the power source of the control base plate 16*d* of the control device 16 are made to be short-circuited to erase the charge of the control device 16.

Accordingly, the charge such as static electricity can be prevented from being applied to prevent the IC or the like from being damaged.

Another embodiment of the automatic faucet according to the present invention will be described hereinafter with reference to FIGS. 21 to 29.

First, the entire construction of the automatic faucet A will be described with reference to FIG. 21. A spout body 111 is placed in a fixed state on a mounting surface 110*a* in the inner part of a bowl 110 of a washbowl B.

The spout body 111 is interiorly provided with a hot and cold water mixing valve 115 of which upstream is connected in communication to a pipe 118 on the hot water supply side and a pipe 119 on the water supply side, an electromagnetic closing valve 114 having its upstream connected in communication to the mixing valve 115 and its downstream connected in communication to a cylindrical opening 130 formed with a discharge port through a hot water supply pipe 12, a controller 116 for controlling the drive of at least the electromagnetic closing valve 114, a manual sensor 124 for sending an output signal to the controller 116, and a battery type power source 117 for feeding power to the electromagnetic 114, the controller 116 and the manual sensor 124.

With the construction as described, when the electromagnetic closing valve 114 is driven and opened, the mixed hot water at a moderate temperature can be supplied from the cylindrical opening 130 provided at extreme end of the spout body 111 into the washbowl B through the pipe 118 on the hot water supply side and the pipe 119 on the cold water supply side, —the mixing valve 115,—the electromagnetic closing valve 114,—the hot water supply pipe 112.

As described above, in the automatic faucet A, the spout 111 is interiorly integrally provided with the hot water and cold water mixing valve 114, the controller 116 for controlling the driving of the electromagnetic closing valve 114, the manual sensor 124 for sending an output signal to the controller 116, and the battery type power source 117 for feeding power to the electromagnetic closing valve 114, the controller 116 and the manual sensor 124. Therefore, the automatic faucet A, irrespective of existing installation or new installation, can be installed merely by ordinary waterworks without necessity of complicated electric wiring works to reduce fitting and installation costs.

Further, in the automatic faucet A, the spout 111 interiorly integrally provided with the hot water and cold water mixing valve 115, the electromagnetic closing valve 114, the manual sensor 124 for sending an output signal to the controller 116, and the battery type power source 117 for feeding power to the electromagnetic closing valve 114, the controller 116 and the manual sensor 124. Therefore, a space for a toilet room or the like can be utilized at maximum.

Next, the spout 111 of the automatic faucet A according to the present invention and the internal construction thereof will be described in detail with reference to FIGS. 21 to 29.

Figure 21:
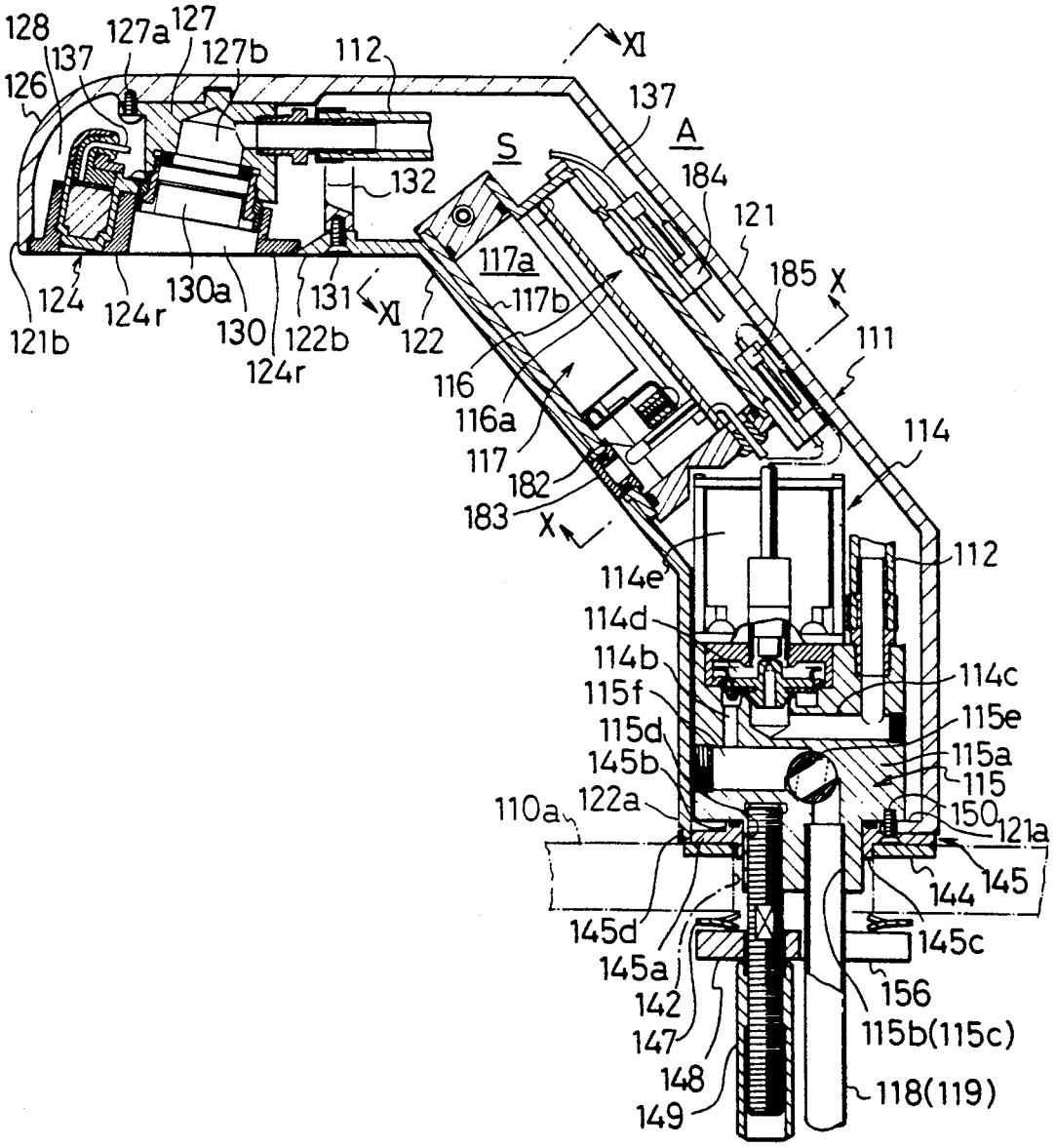
FIG. 21 is a side view showing the entire construction of an automatic faucet according to another embodiment.
Figure 22:
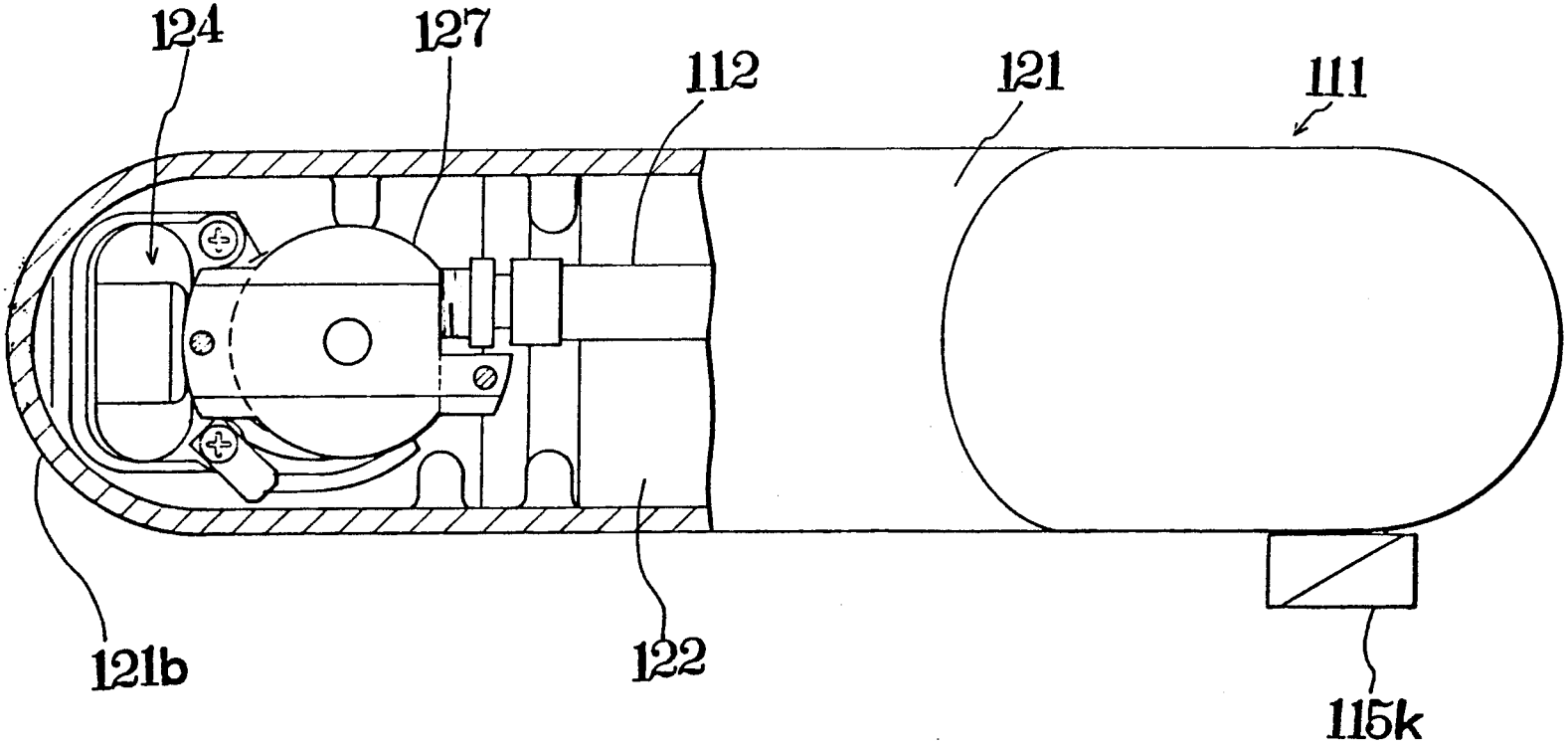
FIG. 22 is a plan view of the same partly sectioned.
Figure 28:
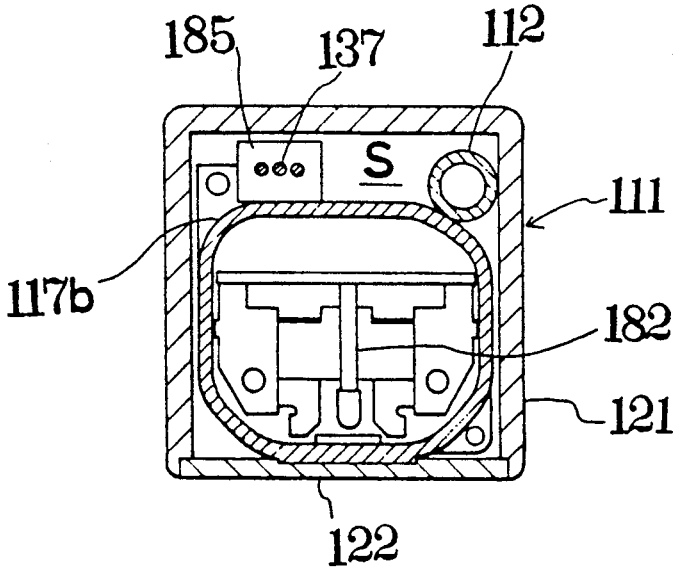
FIGS. 28 and 29 are sectional views taken on lines X—X and XI—XI, respectively, of FIG. 21.
Figure 29:
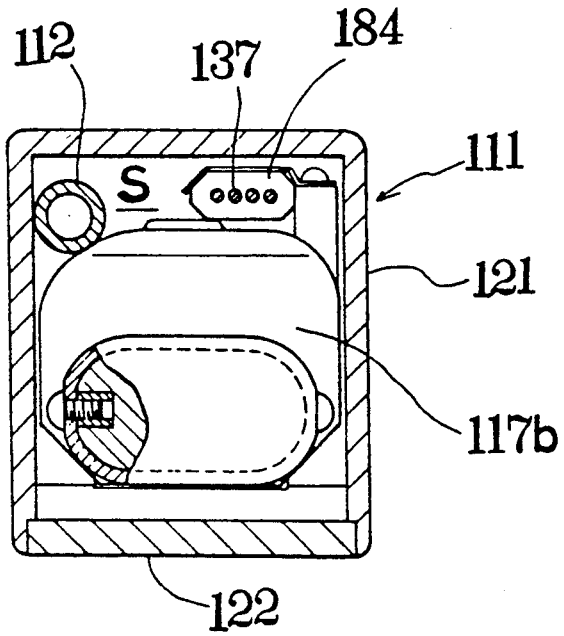

The spout 111 is substantially formed in a manner such that as shown in FIGS. 21, 28 and 29, a protective cover 122 for a controller or the like formed of synthetic resin material such as plastics i removably mounted on the lower surface of a spout 121 made of casting having a U-shaped section with a lower portion opened. The spout 111 is interiorly formed with a fitting space S for a controller or the like to integrally store therein the electromagnetic closing valve 114, the mixing valve 115, the manual sensor 124 and the like other than the controller 116.

In the above-described construction, the construction of the spout 121 will be described. As shown in FIG. 21, the spout 121 has the base end secured to the mounting surface 110*a* in the inner part of the bowl 110 and the extreme end extended in an upwardly inclined state while being bended in a linear state over two stages directed frontwardly of the bowl 110.

Figure 23:
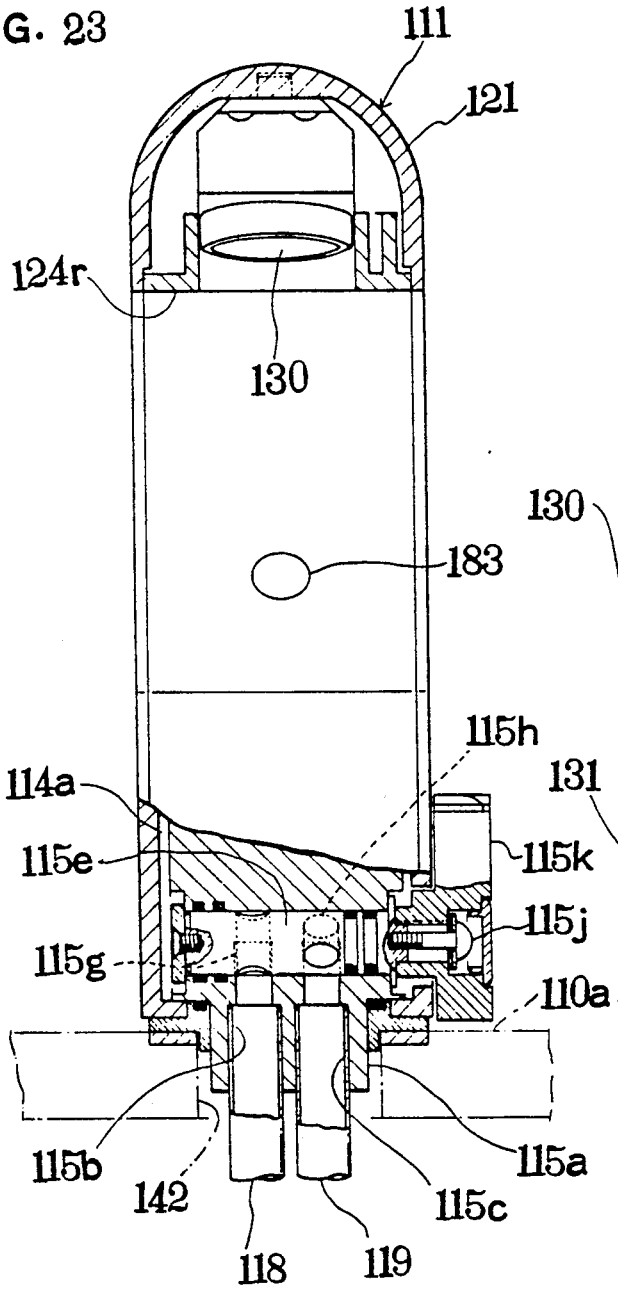
FIG. 23 is a front view of the same partly sectioned.
Figure 24:
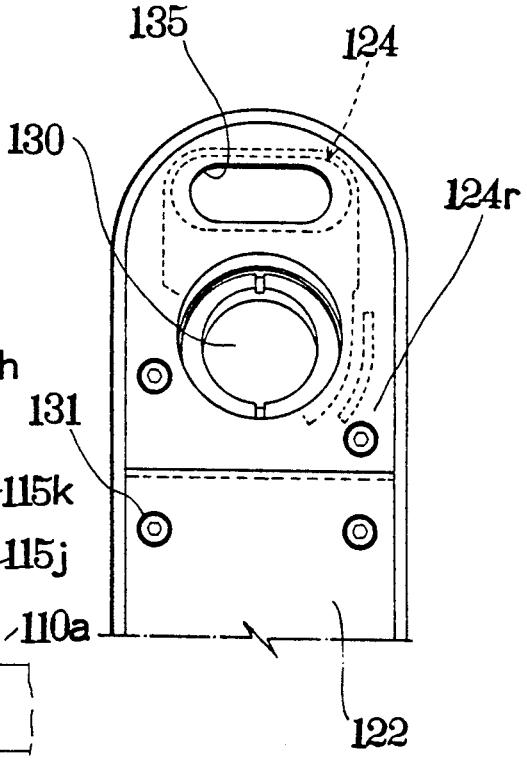
FIG. 24 is a front view of essentioal parts of the same.

The spout 121 has its extreme end alone formed to have an approximately semicircular section as shown in FIG. 23, said extreme end being formed with a front wall 126. Preferably, a how-to use display plate on which a how-to-use of the automatic faucet A is described is mounted on the outer surface of the front wall 126.

Next, the construction of the peripheral edge of the front wall 126 will be described. At the rear portion spaced apart from the front wall 126, a crossing diaphragm block 127 is mounted on the inner surface of the spout body 121 by means of a connecting bolt 127*a*. Between the front wall 126 and the crossing diaphragm block 127, the manual sensor 124 is stored within a sensor installing space 128.

On the other hand, at the rear of the crossing diaphragm block 127 is formed an accommodating space S for a controller or the like extending to the base end of the spout body 121 as shown in FIGS. 21, 28 and 29.

As shown the crossing diaphragm block 127 is interiorly formed with an L-shaped flow path 127*b*, one end of which is connected in communication to the hot water supply pipe 112.

On the other hand, the other end of the L-shaped flow path 127*b* is connected in communication to a cylindrical opening 130 provided at the rear of a sensor supporting plate 124*r* which will be described later.

A discharge water cap 130*a* is removably threadedly mounted within the cylindrical opening 130.

Next, a base portion 121*a* of the spout body 121 will be described. The base portion 121*a* cooperates with a base portion 122*a* of the protective cover 122 for the controller or the like to form a cylindrical spout fitting portion, as shown in FIG. 21.

Then, the construction of the protective cover 122 for the controller or the like will be described. As shown in FIG. 21, the protective cover 122 is formed from a thin lengthy flat plate formed of synthetic resin material, and can be removably mounted on the inside of the spout body 121 to thereby form a spout 111.

In the present embodiment, the mounting of the protective cover 122 for the controller or the like is carried out, as shown in FIG. 21, by threadedly connecting the upper portion of the protective cover 122 for the controller or the like to a rib 132 provided on the inner surface of the spout body 121 and inserting a lower end 122*b* of the protective cover 122 into an insert hole 145*d* provided in an annular collar 145*a* of an upper defining ring 145 which will be described later.

With the construction as described, the protective cover 122 for the controller or the like is connected in a water-tight state over the full length to the spout body 121.

Next, a manual sensor 124 disposed in the fitting space 3 for the controller or the like formed between the spout body 121 and the protective cover 122 for the controller or the like and a sensor cord 137 for connecting the manual sensor 124 and the controller 116 will be described with reference to FIG. 21.

The construction of the manual sensor 124 will be first described. As shown in FIGS. 22, 23, 24, 25 and 26, a sensor support plate 124*r* is mounted between the upper end 122*b* of the protective cover 122 for the controller or the like and the extreme end 121*b* of the spout body 121, the sensor support plate 124*r* being formed in its lower surface with a sensor mounting space 138 with a through-hole 135 for a sensor opened.

The sensor mounting space 138 is interiorly integrally molded with a sensor block 124*a*, a sensor base plate 124*b* and a transparent plate 124*c* by a resin mold agent 124*d* within a rectangular box formed from a rectangular sensor case 124*e* and a case cover 124*f*.

In the above-described construction, sensor fitting holes 124*g* and 124*h* are provided in a spaced apart relation within the sensor block 124*a*, and a projection element 124*i* formed from a phototransistor with the base end connected to the sensor base plate 124*b* and a light receiving element 124*j* formed from a photodiode are fitted within the fitting holes 124*g* and 124*h*, respectively.

When infrared ray projected from the projection element 124*i* and reflected by hands is received by the light receiving element 124*j*, the manual sensor 124 generates a detection output to send an output signal to the controller 116. The electromagnetic closing valve 114 is then driven to automatically discharge hot water from the discharge water cap 130*a*.

The sensor cord 137 for connecting the manual sensor 124 having the above-described construction to the controller 116 will be described.

Figure 25:
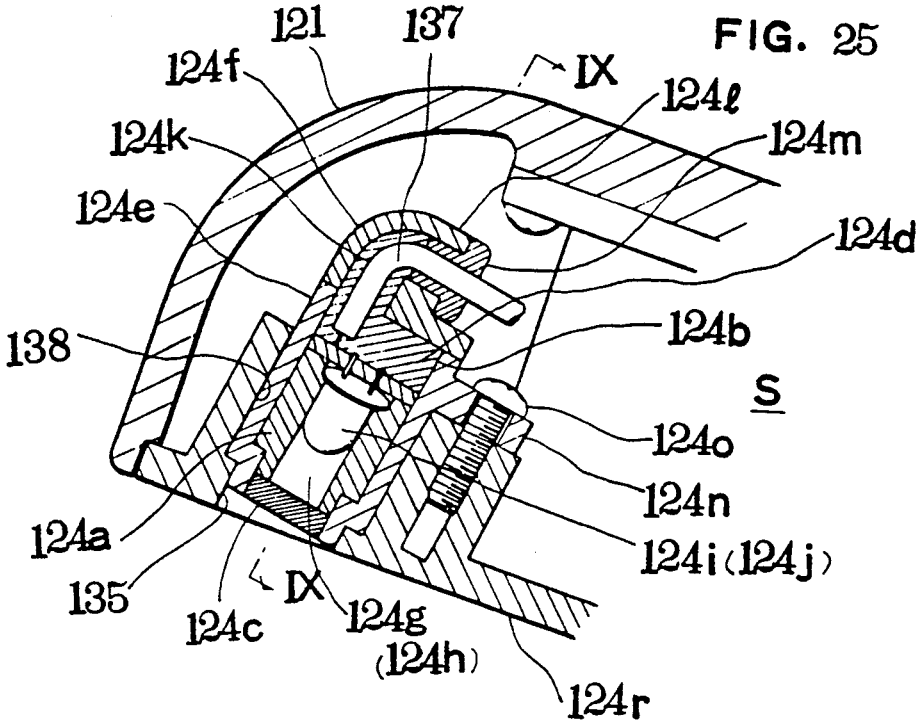
FIG. 25 is a view for explaining the fitting state of a manual sensor at the extreme end of the spout.
Figure 26:
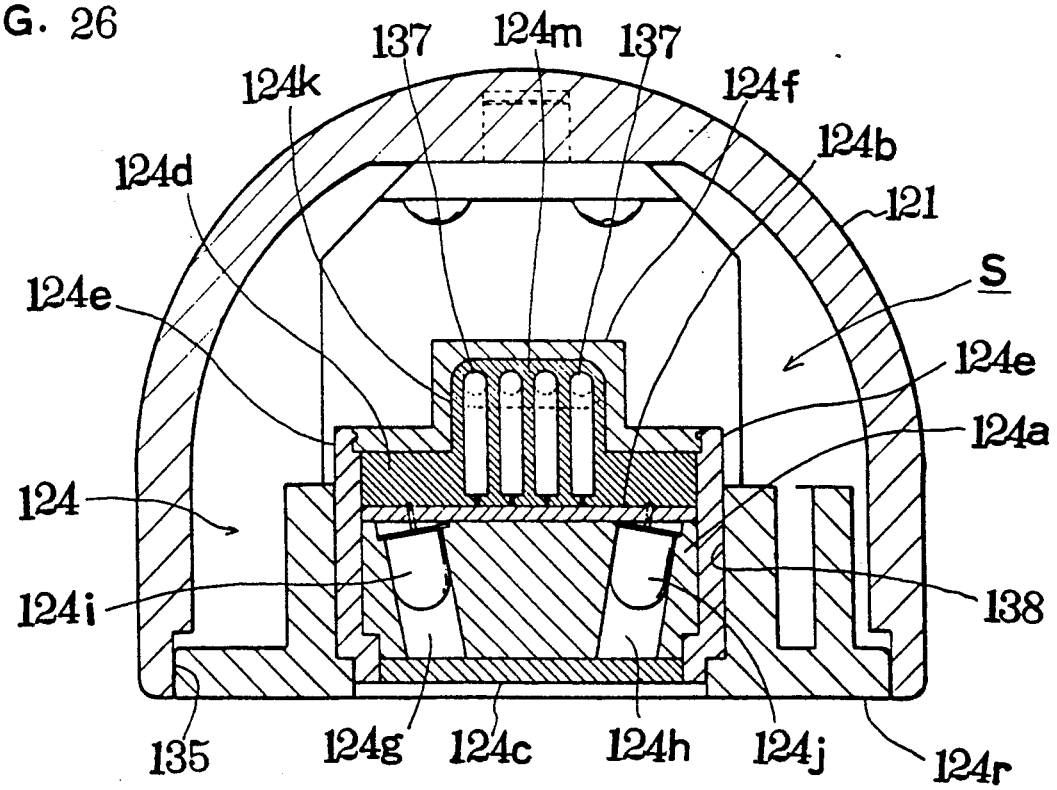
FIG. 26 is a cross-sectional view of a manual sensor taken on line IX—IX of FIG. 25.

As shown in FIGS. 25 and 26, one end of a plurality of sensor cords 137 is connected to the upper surface of the sensor base plate 124*b*, and the other end of the sensor cord 137 is extended into the sensor cord storing space 129 formed between the spout body 121 and the protective cover 122 for the controller or the like through a sensor cord leading path 124*k* provided within the case cover 124*f*, after which the cord is connected to the controller 116 through the cylindrical spout fitting portion of the automatic faucet A.

In the construction as described, as shown in FIGS. 25 and 26, a bushing 124*m* made of rubber is pressed under pressure into a sensor cord leading end 1241 of the sensor cord leading path 124*k*, and one end of the sensor cord 137 is embedded into a resin mold agent 124*d*.

Accordingly, the contactness between the sensor cord 137 and the resin mold agent 124*d* is improved, the water resistance of the manual sensor 124 can be materially improved, and the erroneous operation of the manual sensor 124 can be positively prevented.

In the present embodiment, as shown in FIG. 25, the sensor case 124*e* has a support bracket 124*n* extended rearwardly from the rear wall thereof, the bracket 124*n* being secured in a cantilever state to the protective cover 122 for the controller or the like by means of a fixing bolt 124*o*.

The plurality of sensor cords 137 are extended into the fitting space S for the controller or the like and thereafter connected to a base plate 116*a* of the controller 116 which will be described later, as shown in FIG. 21.

Next, a hot water and cold water supply piping construction will be described with reference to FIG. 21, in which hot water and cold water are supplied from the pipe 118 on the hot water supply side and the pipe 119 on the cold water supply side into the hot water and cold water mixing valve 15 provided on the base portion of the spout body 121 of the spout 111.

As shown in FIGS. 21 and 23, the mixing valve 115 is provided in the base end of the valve body block 115*a* with a pair of a hot water introducing hole 115*b* and a water introducing hole 115*c*, and the upper ends of the pipe 118 on the hot water supply side and the pipe 119 on the cold water supply side are inserted into and connected to both the introducing holes 115*b* and 115*c*, respectively.

The lower ends of the pipe 118 on the hot water supply side and the pipe 119 on the cold water supply side extend through the spout opening 142 provided at the mounting surface 110*a* in the inner part of the bowl 110 and at a position immediately below the base end of the spout body 111, and are extended downwardly.

In the mixing valve 115, the base end of the valve body block 115*a* is provided with an internal threaded hole 115*d* parallel with the hot water introducing hole 115*b* and the water introducing hole 115*c*, and the upper ends of the pipe 118 on the hot water supply side and the pipe 119 on the cold water supply side are inserted into and connected to the introducing holes 115*b* and 115*c*, respectively.

With the construction as described, hot water and cold water can be supplied from the pipe 118 on the hot water supply side and the pipe 119 on the cold water supply side to the mixing valve 115.

Next, a spout fixing construction will be described with reference to FIG. 21, in which the spout 111 is fixed and connected to the place surface 110*a* in the inner part of the bowl 110.

The spout fixing construction is substantially designed so that an upper seal ring 144 and an upper defining ring 145 are disposed in a superposed state upwardly of the spout fitting opening 142 provided in the place surface 110*a* in the inner part of the bowl 110, a shake proof washer 147, a lower fitting washer 148 and a fastening nut 149 are disposed in a superposed state below the spout fitting opening 142, and an external threaded rod 158 having an upper end threadedly mounted to the valve body block 115*a* of the mixing valve 115 is extended downward through the spout fitting opening 142 and a through-hole provided in the lower fitting washer 148, the fastening nut 149 being threadedly mounted on said extended end.

With the construction as described, the upper defining ring 145 comprises, as shown in FIG. 11, an annular collar 145*a* provided in the central peripheral edge thereof, and a spout body fitting portion 145*b* and a bowl fitting portion 145*c* formed above and below thereof.

As shown in FIG. 21, the spout body fitting portion 145*b* is fitted to the base portion of the spout 111 and integrally connected by a connecting bolt 150. On the other hand, a bowl fitting portion 145*c* is fitted to the spout opening 142 provided in the bowl 110 to positively perform locating of the fitting position of the spout fitting 111.

As shown in FIG. 21, since the lower fitting washer 148 has a horse-shoe shape and is provided with a circular cutaway space 156 one end of which is opened, the pipe 118 on the hot water supply side and the pipe 119 on the water supply side can be fitted into and engaged with the circular cutaway space 156 from the external side, thus facilitating the spout fixing work.

Next, the hot water and cold water mixing valve 115 will be described. As shown in FIG. 21, in the mixing valve 115, the valve body block 115*a* is interiorly formed with a mixed hot water and cold water flow path 115*f* closeably communicated with the hot water introducing hole 115*b* and the cold water introducing hole 115*c* through a rotary valve body 115*e*.

As shown in FIGS. 21 and 23, the rotary valve body 115*e* is provided with through-holes 115*g* and 115*h* with axes thereof deviated in a circumferential direction in an axially spaced relation, and a temperature adjusting handle 115*k* is connected to one end thereof by means of a connecting bolt 115*j*. With the construction as described, the temperature adjusting handle 115*k* can be suitably rotated to thereby change a mixting ratio of hot water and cold water flowing into the mixing flow path 115*f* from the hot water introducing hole 115*b* and the water introducing hole 115*c* whereby the mixed hot water and cold water at a desired temperature can be obtained.

While in the present empodiment, the mixing valve 115 has been of the manual type, it is to be noted that the valve may comprise an automatic valve controlled by the controller 116 which will be described later.

Next, the electromagnetic valve 114 will be described with reference to FIGS. 21 and 27.

In the present embodiment, the electromagnetic closing valve 114 comprises a valve fitting block 114*a* integrally formed above the valve body block 115*a* of the mixing valve 115, a mixed hot water and cold water inlet path 114*b* and a mixed hot water and cold water outlet path 114*c* formed interiorly of the valve fitting block 114*a*, a pilot type diaphragm valve 114*d* disposed between the inlet path 114*b* and the outlet path 114*c*, and a latching solenoid 114*e* disposed above the diaphragm valve 114*d*.

Figure 27:
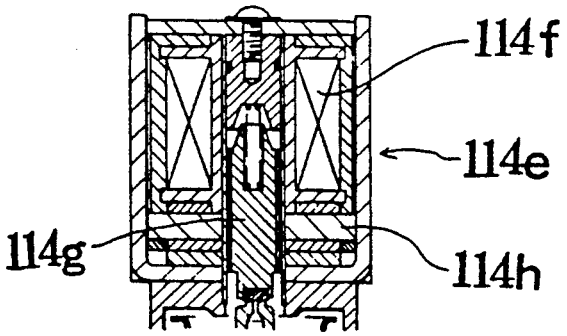
FIG. 27 is an explanatory view of the internal construction of an electromagnetic closing valve.

The latching solenoid 114*e* comprises, as shown in FIG. 27, a solenoid 114*f*, a plunger 114*g* disposed movably forward and backward in an axial direction within the solenoid 114*f*, and a permanent magnet 114*h* for latching.

With the construction as described, by applying and releasing a voltage from the electromagnetic closing valve 114 to move the plunger 114*g* forward and backward, the diaphragm valve 114*d* is opened and closed to provide communication and cutoff between the inlet path 114*b* and the outlet path 114*c*.

Next, the battery type power source 117 will be described. As shown in FIGS. 21, 28 and 29, the power source 117 is constituted by a dry cell 117*a* removably mounted within a dry cell case 117*b* mounted on the inner surface in the midst of the protective cover 122 for the controller or the like.

By feeding a low voltage from the dry cell 117*a* to the electromagnetic closing valve 114, the manual sensor 124 and the controller, it is possible to positively prevent trouble such as electric shock.

Next, the controller 116 will be described. As shown in FIGS. 21, 28 and 29, the controller 116 comprises a control base plate 116*a* disposed above the dry cell case 117*b* of the battery type power source 117, and controller body 116*b* provided above the control base plate 116*a*.

Another construction in the illustrated embodiment will be briefly described. In FIG. 21, a power-off display lamp 182 formed from an LED or the like is connected to one side of the control base plate 116*a*, and a transparent window 183 for facilitating viewing from outside is provided in a portion of the protective cover 122 for the controller ahead of the display lamp 182.

Cord supporters 184 and 185 for supporting sensor cords 137 are provided on the upper surface of the dry cell case 117*b* of the battery type power source 117.

The operation of the automatic faucet A having the above-described construction will be briefly described.

As previously mentioned, the dry cell 117*a* is mounted on the dry cell case 117*b* whereby a low voltage is applied to the controller 116, the electromagnetic closing valve 114 and the manual sensor 124 to set the automatic faucet A in an initial state.

When a user reaches out below the discharge water cap 130*a* positioned at the extreme end of the automatic faucet A after attending to one's business, the manual sensor 124 issues an ON-output, and the controller 116 sends a drive signal to the electromagnetic closing valve 114 in response to the ON-output to drive the electromagnetic closing valve 114 so that as shown in FIG. 3, the plunger 114*c* is moved backward to open the pilot type diaphragm valve 114*d*.

Thereby, the mixed hot water and cold water at a moderate temperature adjusted by the mixing valve 114 can be discharged out of the discharge water cap 130*a* to clean hands.

When a user draws his hands after cleaning, the manual sensor 124 does not detect hands any longer. Therefore, an off-output is sent to the controller 116 so that the controller 116 causes the plunger 114*g* of the electromagnetic closing valve 114 to move forward in response to the OFF-output to close it by the pilot type diaphragm valve 114*d*.

In the above-described operation, in the case where the electromagnetic closing valve 114 is subjected to latching solenoid driving, opening or closing state of valve can be self-maintained even if a power is not fed after the electromagnetic closing valve 114 has been once driven to be opened or closed, thus saving power.

As described above, the automatic faucet according to the present invention has the merits as follows:

(1) The automatic faucet is integrally provided in its body with the hot water and cold water mixing valve, the electromagnetic closing valve, the controller for controlling the driving of the electromagnetic closing valve, the manual sensor for sending an output signal to the controller, and the battery type power source for feeding a power to the electromagnetic closing valve, the controller and the manual sensor. Therefore, the automatic faucet, irrespective of existing installation and new installation, can be installed merely by ordinary waterworks without necessity of complicated electric-works, thus reducing fitting and installation costs.

(2) In the present embodiment, the automatic faucet compactly stores the hot water and cold water mixing valve, the electromagnetic closing valve, the controller for controlling the electromagnetic closing valve, the manual sensor for sending an output signal to the controller and the battery type power source for feeding a power to the electromagnetic closing valve, the controller and the manual sensor. Therefore, the installation space for the automatic faucet along will suffice, and the space for the toilet room can be utilized at maximum.

We claim:

1. In an automatic faucet comprising a spout body fixedly mounted on a mounting surface and provided with a discharge water port at one end thereof, and a sensor for sensing an object which approaches a region adjacent said discharge port, the improvement wherein said faucet has a drive portion unit for supplying water to said sprout body in response to a sensor output from said sensor, said drive portion unit integrally housing therein an electromagnetic closing valve and a control device for opening and closing said electromagnetic closing valve in response to a sensor output from said sensor, said electromagnetic closing valve and said control device being electrically connected via a contact, said electromagnetic closing valve and said control device being separable from one another in a manner that terminates said electrical connection via said contact, said control device being encased in a box-shaped water-tight protective cover which forms a separable part of said drive portion unit, said protective cover being removably fitted into an opening of said drive portion unit so that simultaneous with the removal of said protective cover encasing said control device from said drive portion unit, said electrical connection via said contact is terminated.

2. The automatic faucet of claim 1 comprising a dry cell case for storing a dry cell, said case being integrally connected to a control base plate fitting bracket forming a part of said control device to constitute an assembly, said assembly being incorporated in said drive portion unit.

3. The automatic faucet of claim 2 comprising a contact for said dry cell connected to said control base plate, said dry cell contact being mounted on said control base plate fitting bracket, said dry cell and control base plate being electrically connected via said dry cell contact when said dry cell is mounted in said dry cell case.

4. The automatic faucet of claim 2 comprising a contact for said dry cell connected to said control base plate and being mounted on said control base plate fitting bracket, said dry cell and said control base plate being electrically connected via said dry cell contact upon mounting said dry cell in said dry cell case, and when said dry cell is not mounted in said dry cell case, both poles of a power source input terminal of said control base plate of said control device being short circuited to discharge said control device.

5. The automatic faucet of claim 1 wherein said sensor comprises a sealed box disposed in a sensor mounting space formed within the spout, the sealed box being molded of resin mold agent to form a sensor block enclosing a projection element and a light receiving element, a sensor base plate having one end of a sensor cord connected thereto, and a rubber bushing mounted on a leading portion from the sealed box for the sensor cord.

6. The automatic faucet of claim 1 comprising a water discharge flow path connecting pipe, the upper end of which is connected to the lower portion of the spout, said water discharge flow path connecting pipe extending downwardly through a spout fitting opening provided in a spout fitting plate, a lower fitting washer and a fastening nut mounted in a vertically superposed state around the outer peripheral surface of an extended portion below the discharge water flow path connecting pipe, said fastening nut being threaded on an external thread portion provided on the extended portion below the discharge water flow path connecting pipe to press the lower fitting washer to the spout fitting plate, and said lower fitting washer having an approximately horse-shoe shape to form a cutaway space in the outer peripheral edge thereof, sensor cord means connected to the manual sensor mounted on the spout inserted into said cutaway space, a downwardly extending guide pin for guiding the washer below the spout, and a pin insert hole for inserting the guide pin in the lower washer.

7. The automatic faucet of claim 1 wherein the drive portion unit is interiorly integrally provided with an electromagnetic closing valve, a control device for opening and closing the electromagnetic closing valve in response to a sensor output from said sensor, and a water stop valve, said drive portion unit being separably connected to a leg having a base end connected to a wall.

8. The automatic faucet of claim 7 wherein said leg comprises a hot water supply side pipe and a cold water supply side pipe secured to the wall.

9. The automatic faucet of claim 1 wherein a pipe leading opening for leading a pipe for supplying hot water and cold water from the electromagnetic closing valve to the spout is provided in a top plate of the drive portion unit, the drive portion unit is interiorly provided with the electromagnetic closing valve and the control device for opening and closing the electromagnetic closing valve in response to a sensor output from said sensor, and a dew drop preventing weir plate is provided for preventing outflow of dew water into the control portion is provided in the peripheral edge of the pipe leading opening.

10. The automatic faucet of claim 1 wherein the drive portion unit encloses the electromagnetic closing valve and the control device for opening and closing the electromagnetic closing valve in response to a sensor output from said sensor, power is fed from a dry cell to the electromagnetic closing valve, the control device and said sensor, a power-off display lamp is connected to be actuated when a feed voltage of said dry cell drops to a level below a set voltage, and a transparent window is provided at a part of the peripheral wall of the drive portion unit and at a location facing the power-off display lamp.

11. The automatic faucet of claim 1 wherein a how-to-use display plate is mounted on the surface of the spout at a location capable of being viewed by the user.

12. The automatic faucet of claim 1 wherein the drive portion unit encloses a temperature setting screw of said mixing valve therein and said screw is exposed to the front surface of a front panel of a casing for encasing said mixing valve, a collar ring is fitted over said temperature setting screw, a cover ring is formed in its inner peripheral surface with a projection and a notch extending from the surface to the inside is fitted on the outside of the collar ring, the cover ring is secured to the temperature setting screw with interference of the temperature setting screw and the projection, and a part of the collar ring can be externally viewed through said notch.

13. An automatic faucet comprising:

a) an elongated spout body having a base plate and being fixed to a mounting plate surface, said spout body having a discharge water port at a first end thereof;

b) a discharge water flow path extending internally through the full length the spout body, said flow path having a second opening at a second end thereof adapted to be connected to hot water and cold water supply pipes, and a first opening at said first end in communication with the water discharge port;

c) a protective cover for the sensor is removably mounted on the inner surface of the spout body, said cover cooperating with the spout body to form a spout and forming a fitting space for a storing a sensor, and a sensor cord is provided extending between the inner surface of the spout body and the protective cover;

d) a drive portion unit for supplying mixed hot and cold water to said flow path at a moderate temperature from hot and cold water supply pipes;

e) said drive portion unit being housed in said spout body, said drive portion unit comprising a hot water and cold water mixing valve, wherein the upstream side of said valve is in communication with the hot water and cold water supply pipes, and further comprising an electromagnetic closing valve having an upstream side coupled to said mixing valve, the downstream side of said closing valve being connected to a discharge port, and further comprising a controller for controlling the driving of at least the electromagnetic closing valve, a sensor for sending an output signal to the controller, and a battery type power source for feeding power to at least the electromagnetic closing valve, the controller and the sensor.

14. An automatic faucet comprising:

a) an elongated spout body having a base plate and being fixed to a mounting plate surface, said spout body having a discharge water port at a first end thereof;

b) a discharge water flow path extending internally through the full length the spout body, said flow path having a second opening at a second end thereof adapted to be connected to hot water and cold water supply pipes, and a first opening at said first end in communication with the water discharge port;

c) a protective cover for the sensor is removably mounted on the inner surface of the spout body, said cover cooperating with the spout body to form a spout and forming a fitting space for a storing a sensor, and a sensor cord is provided extending between the inner surface of the spout body and the protective cover; a d) a drive portion unit for supplying mixed hot and cold water to the flow path at a moderate temperature from hot and cold water supply pipes in response to a sensor output from said sensor, said drive portion unit enclosing an electromagnetic closing valve and a control device for opening and closing the electromagnetic closing valve in response to a sensor output from said sensor;

e) a dry cell case for storing a dry cell therein integrally connected to a control base plate fitting bracket forming a part of the control device to constitute an assembly, said assembly being incorporated into the drive portion unit; and f) a contact for the dry cell connected to the control base plate being mounted on the control base plate fitting bracket, wherein the dry cell and the control base plate are electrically connected via the contact for the dry cell when the dry cell is mounted in the dry cell case.

15. An automatic faucet comprising:

a) an elongated spout body having a base plate and being fixed to a mounting plate surface, said spout body having a discharge water port at a first end thereof;

b) a discharge water flow path extending internally through the full length the spout body, said flow path having a second opening at a second end thereof adapted to be connected to hot water and cold water supply pipes, and a first opening at said first end in communication with the water discharge port;

c) a protective cover for the sensor is removably mounted on the inner surface of the spout body, said cover cooperating with the spout body to form a spout and forming a fitting space for a storing a sensor, and a sensor cord is provided extending between the inner surface of the spout body and the protective cover;

d) a drive portion unit for supplying mixed hot and cold water to the flow path at a moderate temperature from hot and cold water supply pipes in response to a sensor output from said sensor, said drive portion unit enclosing an electromagnetic closing valve and a control device for opening and closing the electromagnetic closing valve in response to a sensor output from said sensor;

e) a dry cell case for storing a dry cell therein integrally connected to a control base plate fitting bracket forming a part of the control device to constitute an assembly, said assembly being incorporated into the drive portion unit; and f) a contact for the dry cell connected to the control base plate being mounted on the control base plate fitting bracket, wherein the dry cell and the control base plate are electrically connected via the contact for the dry cell when the dry cell is mounted in the dry cell case, the poles of the power source input terminal of the control base plate of the control device being short circuited when the dry cell is not mounted in the dry cell case, to thereby erase a change on the control device.

16. An automatic faucet comprising:

a) an elongated spout body having a base plate and being fixed to a mounting plate surface, said spout body having a discharge water port at a first end thereof;

b) a discharge water flow path extending internally through the full length the spout body, said flow path having a second opening at a second end thereof adapted to be connected to hot water and cold water supply pipes, and a first opening at said first end in communication with the water discharge port;

c) a protective cover for the sensor is removably mounted on the inner surface of the spout body, said cover cooperating with the spout body to form a spout and forming a fitting space for a storing a sensor, and a sensor cord is provided extending between the inner surface of the spout body and the protective cover;

d) a drive portion unit for supplying mixed hot and cold water to the flow path at a moderate temperature from hot and cold water supply pipes in response to a sensor output from said sensor;

e) a discharge water flow path connecting pipe having an upper end connected to a lower portion of said spout body, said discharge water flow path extending downwardly through a spout fitting in a spout fitting plate; and f) a lower fitting washer and a fastening nut mounted in a vertically superposed state around the outer peripheral surface of an extended portion below the discharge water flow path connecting pipe, said fastening nut being threaded on an external threaded portion on said extended portion below the discharge water flow path connecting pipe to press the lower fitting washer to the spout fitting plate, said lower fitting washer being approximately in the shape of a horse-shoe to form a cutaway space in the outer peripheral edge thereof, sensor cords being connected to the sensor on the spout and being inserted into said cutaway space;

g) a downwardly extending guide pin for guiding the washer being provided below the spout; and h) a pin insert hole for inserting a guide pin being provided in the lower washer.

17. An automatic faucet comprising:

a) an elongated spout body having a base plate and being fixed to a mounting plate surface, said spout body having a discharge water port at a first end thereof;

b) a discharge water flow path extending internally through the full length the spout body, said flow path having a second opening at a second end thereof adapted to be connected to hot water and cold water supply pipes, and a first opening at said first end in communication with the water discharge port;

c) a protective cover for the sensor is removably mounted on the inner surface of the spout body, said cover cooperating with the spout body to form a spout and forming a fitting space for a storing a sensor, and a sensor cord is provided extending between the inner surface of the spout body and the protective cover; and d) a drive portion unit for supplying mixed hot and cold water to the flow path at a moderate temperature from hot and cold water supply pipes in response to a sensor output from said sensor, said drive portion unit enclosing an electromagnetic closing valve, a control device for opening and closing the electromagnetic closing valve in response to a sensor output from said sensor, and a thermostat type mixing valve;

e) a temperature setting screw on said mixing valve, said setting screw being exposed to the front surface of a front panel of said casing for said mixing valve, a collar ring fitted over said temperature setting screw, a cover ring having an internal surface with a projection and a notch extending from the surface to the inside being fitted on the outside of the collar ring, the cover ring being secured to the temperature setting screw with interference of the temperature setting screw and the projection, and a part of the collar ring being viewable from externally of said faucet through said notch.

* * * * *